US007534155B2

(12) United States Patent
Yonehara et al.

(10) Patent No.: US 7,534,155 B2
(45) Date of Patent: May 19, 2009

(54) METHOD OF MANUFACTURING DISPLAY PANEL, AND SUPPORTING BED FOR SUBSTRATE OF THE DISPLAY PANEL

(75) Inventors: Hiroyuki Yonehara, Osaka (JP); Masanori Suzuki, Osaka (JP); Makoto Morita, Hyogo (JP); Daisuke Adachi, Kyoto (JP); Yasuyuki Akata, Osaka (JP); Kenji Tanimoto, Hyogo (JP)

(73) Assignee: Panasonic Corporation, Osaka (JP)

( * ) Notice: Subject to any disclaimer, the term of this patent is extended or adjusted under 35 U.S.C. 154(b) by 355 days.

(21) Appl. No.: 10/589,819

(22) PCT Filed: Jan. 11, 2006

(86) PCT No.: PCT/JP2006/300173

§ 371 (c)(1),
(2), (4) Date: Aug. 17, 2006

(87) PCT Pub. No.: WO2006/075589

PCT Pub. Date: Jul. 20, 2006

(65) Prior Publication Data

US 2007/0167102 A1 Jul. 19, 2007

(30) Foreign Application Priority Data

Jan. 12, 2005 (JP) ..... 2005-004812
Jul. 14, 2005 (JP) ..... 2005-205289

(51) Int. Cl.
*H01J 9/00* (2006.01)

(52) U.S. Cl. ..... 445/24; 445/25; 445/66

(58) Field of Classification Search ..... 445/24, 445/25, 66

See application file for complete search history.

(56) References Cited

U.S. PATENT DOCUMENTS 5,984,748 A * 11/1999 Ritter et al. ..... 445/24

FOREIGN PATENT DOCUMENTS

| | | |
|---|---|---|
| JP | 2002-133743 | 5/2002 |
| JP | 2003-051251 | 2/2003 |
| JP | 2004-095215 | 3/2004 |

* cited by examiner

*Primary Examiner*—Mariceli Santiago
(74) *Attorney, Agent, or Firm*—Wenderoth, Lind & Ponack, L.L.P.

(57) ABSTRACT

A method of manufacturing display panels includes forming a material layer on a substrate, and baking the material layer formed on substrate which is placed on a supporting bed. The supporting bed is formed of a first supporting bed and a second supporting bed placed on the first supporting bed. A difference in thermal expansion coefficient between the second supporting bed and the substrate is smaller than a difference in thermal expansion coefficient between the first supporting bed and the substrate, and the substrate is placed on the second supporting bed such that the substrate is positioned entirely within the perimeter of the second supporting bed during the baking and heating. This structure allows reduction of scratches on a surface of the substrate.

19 Claims, 18 Drawing Sheets

FIG. 20A – PRIOR ART
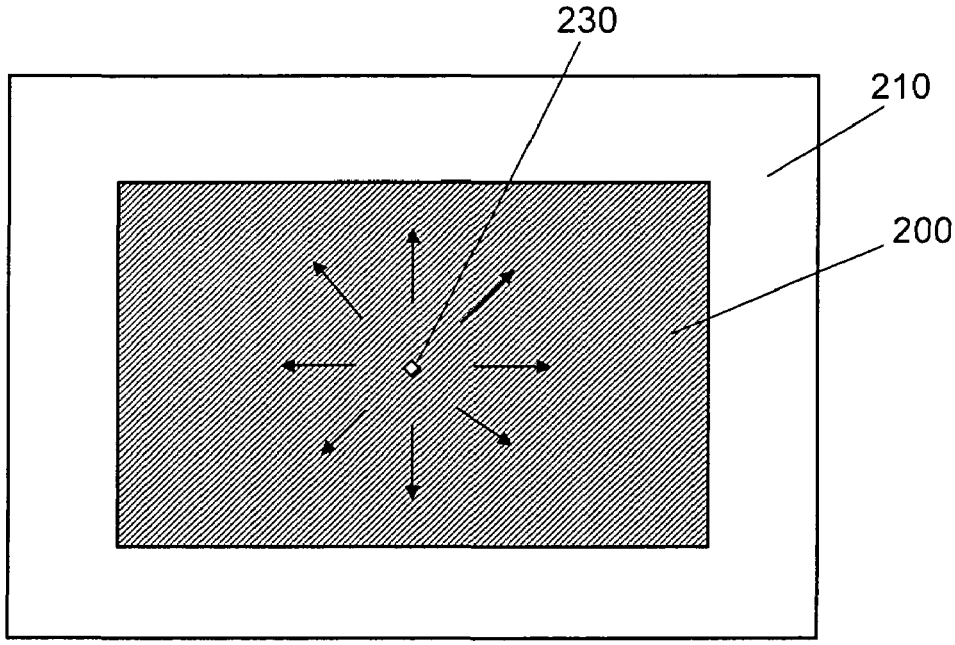
FIG. 20B – PRIOR ART
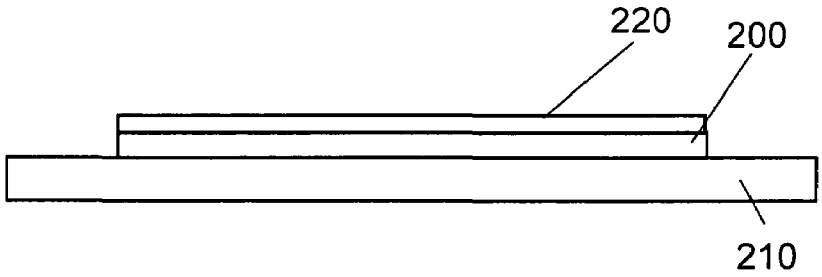

METHOD OF MANUFACTURING DISPLAY PANEL, AND SUPPORTING BED FOR SUBSTRATE OF THE DISPLAY PANEL

This application is a U.S. national phase application of PCT International Application PCT/JP2006/300173.

TECHNICAL FIELD

The present invention relates to a method of manufacturing display panels, more particularly, a method of suppressing the production of scratches on the surfaces of the panels, and it also relates to a supporting bed for a substrate of the display panels.

BACKGROUND ART

A plasma display panel (hereinafter simply referred to as a "PDP" or a "panel") as a kind of display panel is formed of a front panel and a rear panel confronting each other, and these panels are sealed with a sealing member at their peripheries. A discharge space is formed between the front and rear panels, and discharge gases such as neon and xenon are filled in the discharge space.

The front panel comprises the following elements:

plural display-electrode pairs including scan electrodes and sustain electrodes both formed in stripe patterns on a surface of a glass substrate; and a dielectric layer and a protective layer both covering the display electrode pairs.

Each one of the display electrode pairs is formed of a transparent electrode and a metallic auxiliary electrode formed on the transparent electrode.

The rear panel comprises the following elements:

plural address electrodes formed on another glass substrate in stripe patterns along the direction intersecting at right angles with the display electrode pairs;

a base dielectric layer covering these address electrodes;

barrier-ribs formed in stripe patterns and partitioning the discharge space along respective address electrodes; and a phosphor layer painted in red, green, and blue sequentially at respective grooves between the barrier-ribs.

The display electrode pairs intersect with the address electrodes at right angles, and the intersections form discharge cells which are arranged in matrix patterns. A set of three discharge cells colored in red, green, and blue respectively lined along the display electrode pair forms a pixel for color display. The PDP shows a color video through the following mechanism: a given voltage is applied between the scan electrode and address electrode, and between the scan electrode and the sustain electrode sequentially, thereby generating gas-discharge, which produces ultraviolet ray. The ultraviolet ray energizes the phosphor layer for light emission, so that a color video can be displayed.

The front and rear panels are manufactured in this way: structural elements such as the display electrode pairs, and the dielectric layer are formed on the front glass substrate in a given shape and pattern. Structural elements such as the address electrodes, base dielectric layer, barrier-ribs, and phosphor layer are formed on the rear glass substrate in a given shape and pattern. The respective materials are applied on each one of the glass substrates, and undergo patterning by a photolithography method or a sand blast method as required, then baked.

The predetermined materials as discussed above are applied on the respective glass substrates for forming a material layer, then the layer is baked to be hardened, thereby forming the respective structural elements on the glass substrate. In the baking and hardening step, the glass substrate is placed on a supporting bed and put into an baking furnace together with the bed for baking the material layer. In the baking furnace, a temperature as high as 500-600° C. is kept, and therefore, the bed is made of ceramic material such as neoceram N-0 or N-11 (names of products made by Nippon Electric Glass Co., Ltd.) because of their high heat resistance, and the glass substrate employs highly distortion-resistant glass. An instance of preventing a misalignment between the supporting bed and the substrate during the forgoing baking and hardening step is disclosed in the Unexamined Japanese Patent Publication No. 2003-51251.

However, plural small scratches are produced on the glass substrate surface, contacting the supporting bed due to a difference in thermal expansion coefficient between the supporting bed and the substrate during the baking and hardening step discussed above. To be more specific, heat resistant material having a thermal expansion coefficient of $-0.4\times10^{-6}/°$ C. is used for the supporting bed, and highly distortion-resistant glass having a thermal expansion coefficient of $8.3\times10^{-6}/°$ C. is used as the glass substrate. Since the bed and the substrate have such a difference between their thermal expansion coefficients, the surface of the glass substrate is rubbed with the supporting bed, thereby being scratched. In the case of the rear panel, these scratches are less significant; however, in the case of the front panel on which a video is displayed, the scratches degrade the display quality and reduce the manufacturing yield.

SUMMARY OF INVENTION

The present invention is directed to a method of manufacturing display panels, and the method comprises the following steps:

forming a material layer on a substrate; and baking the substrate having the material layer formed thereon and placed on a supporting bed.

The supporting bed is formed of a first supporting bed and a second supporting bed placed on the first one. A difference in thermal expansion coefficient between the second supporting bed and the substrate is set smaller than a difference in thermal expansion coefficient between the first supporting bed and the substrate. The substrate is placed on the second supporting bed so that the second supporting bed can exist around the substrate during the baking step, then the baking furnace applies heat for baking.

The manufacturing method discussed above allows suppressing the production of scratches caused by the difference in the thermal expansion coefficient between the bed and the substrate. Because the substrate is placed on the second supporting bed, which has a smaller difference in thermal expansion coefficient than a difference between the first supporting bed and the substrate, and the second supporting bed exists around the substrate (i.e. the substrate is disposed entirely within a perimeter of the second supporting bed) and during the baking step. The method also prevents the production of scratches caused by rubbing the substrate with the ends of the second supporting bed. As a result, a quality display panel can be obtained.

BRIEF DESCRIPTION OF THE DRAWINGS

FIG. 20A shows a plan view illustrating a structure of a conventional supporting bed to be used in a method of manufacturing a display panel.

FIG. 20B shows a front view illustrating a structure of a conventional supporting bed to be used in a method of manufacturing a display panel.

DETAILED DESCRIPTION OF THE INVENTION

Exemplary embodiments of the present invention are demonstrated hereinafter with reference to the accompanying drawings.

First Embodiment

The present invention is applicable to display panels, e.g. PDPs, which undergo the manufacturing step of baking and hardening a material layer made of the structural elements and formed on a glass substrate. In the embodiments of the present invention, the PDP is taken as an example of those display panels.

Figure 1:
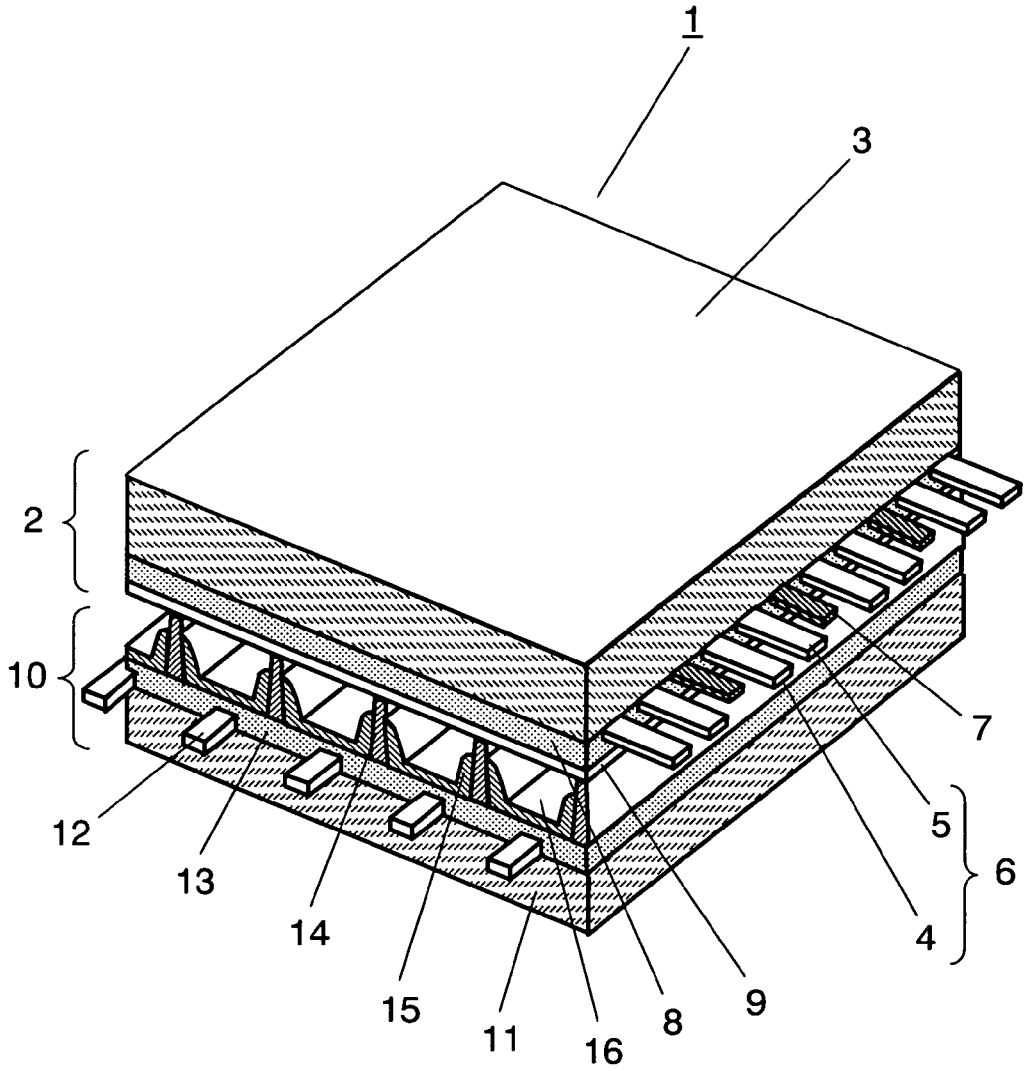
FIG. 1 shows a perspective view illustrating a structure of a PDP.

FIG. 1 shows a perspective view of a PDP. A fundamental structure of the PDP is similar to the AC surface discharge PDP widely available. As shown in FIG. 1, PDP 1 comprises the following elements:

- front panel 2 including front glass substrate 3;
- rear panel 10 including rear glass substrate 11 and confronting front panel 2; and
- sealing member, formed of glass frit, for sealing front panel 2 and rear panel 10 at their peripheries in an airtight manner.

Discharge gases such as neon (Ne) and xenon (Xe) are filled in discharge space 16 inside sealed PDP 1 at a pressure of 400-600 Torrs.

On a principal face of front glass substrate 3, display electrode pairs 6, each pair of pairs 6 is formed of scan electrode 4 and sustain electrode 5, are arranged in stripe patterns in parallel with black stripes 7 (light-proof layer). Dielectric layer 8, made of Pb—B based glass and working as a capacitor, is formed over display electrode pairs 6 and light-proof layer 7. Protective layer 9 made of magnesium oxide (MgO) is formed on the surface of dielectric layer 8.

On a principal face of rear glass substrate 11, address electrodes 12 are placed in stripe patterns along the direction intersecting with scan electrodes 4 or sustain electrodes 5 at right angles, and base dielectric layer 13 covers address electrodes 12. Barrier-ribs 14 having a given height are formed on base dielectric layer 13 between address electrodes 12, such that barrier-ribs 14 partition discharge space 16. Phosphor layer 15 is applied to grooves between barrier-ribs 14. Phosphor layer 15 emits light in red, green, and blue sequentially on each address electrode 12 by ultraviolet ray radiation. Discharge cells are formed at the intersections of scan electrodes 4, sustain electrodes 5 and address electrodes 12. The discharge cell having phosphor layer 15 of red, green and blue arranged along display electrode pairs 6 works as a pixel for color display.

Next, a method of manufacturing the PDP is demonstrated hereinafter. First, scan electrode 4, sustain electrode 5 and light-proof layer 7 are formed on the principal face of front glass substrate 3. Scan electrode 4 and sustain electrode 5 include a transparent electrode made of indium tin oxide (ITO) and tin oxide (SnO2), and a metallic bus electrode made of silver paste and formed on the transparent electrode. These electrodes are formed through patterning by a photolithography method. These electrode-material layers are baked and hardened at a desirable temperature. Light-proof layer 7 is also formed by applying paste containing black pigment by a screen printing method for patterning, or by applying paste containing black pigment on all over the glass substrate and patterning by the photolithography method, then the patterned paste is baked and hardened.

A dielectric paste layer (dielectric material layer) is formed by applying dielectric paste on front glass substrate 3 by a die-coating method such that this layer covers scan electrode 4, sustain electrode 5 and light-proof layer 7. Then substrate 3 is left for a given time for leveling the surface of the applied dielectric paste to become flat. After that, the dielectric paste layer is baked and hardened, so that dielectric layer 8, which covers scan electrode 4, sustain electrode 5 and light-proof layer 7, is formed. The dielectric paste is the paint including dielectric material such as glass powder, and binder as well as solvent. Next, protective layer 9 made of magnesium oxide (MgO) is formed by a vacuum evaporation method on dielectric layer 8. The given structural elements (scan electrode 4, sustain electrode 5 and light-proof layer 7, dielectric layer 8, and protective layer 9) are formed through the foregoing steps, and front panel 2 is thus completed.

Rear panel 10 is formed in the following way: First, on a principal surface of rear glass substrate 11, a metallic film is formed, e.g. silver paste is applied and patterned by a screen printing method, or a metal film is formed on the entire face of substrate 11 then the film undergoes patterning by the lithography method, so that a material layer to be a structural element for address electrode 12 is formed. This layer is baked and hardened at a given temperature, and address electrode 12 is thus formed. Next, a dielectric paste layer is formed by applying dielectric paste on rear glass substrate 11 by the die-coating method such that this layer covers address electrode 12. Then the dielectric paste layer is baked for forming base dielectric layer 13. The dielectric paste is the paint including dielectric material such as glass powder, and binder as well as solvent.

Next, a barrier-rib layer is formed by applying barrier-rib preparing paste containing barrier-rib material onto base dielectric layer 13, and being provided with patterning to be patterned into a given format. The barrier-rib material layer thus formed is then baked and hardened, so that barrier-rib 14 is formed. The photolithography method or the sand blast method is used for patterning the barrier-rib preparing paste applied onto base dielectric layer 13.

Then phosphor layer 15 is formed by applying phosphor paste containing phosphor material onto base dielectric layer 13 between adjacent barrier-ribs 14 and also on the lateral face of barrier-ribs 14 before this paste is baked and hardened. Rear panel 10 including the given structural elements on rear glass substrate 11 is thus formed by the foregoing steps.

Front panel 2 and rear panel 10 thus obtained are placed such that they confront each other and scan electrode 14 intersects with address electrode 12 at right angles. The peripheries of these two panels are sealed with glass frit, and discharge gas containing neon and xenon, etc. are filled in the discharge space 16 for completing PDP 1.

As discussed above, the metallic bus electrode (not shown), light-proof layer 7, dielectric layer 8 disposed on front glass substrate 3, and address electrode 12, base dielectric layer 13, s-rib 14, and phosphor layer 15 disposed on rear glass substrate 11 are formed in this way: respective materials of these elements are applied on substrate 3 or substrate 11, then the materials applied undergo the patterning as required, and then baked and hardened. The baking step is carried out to the respective elements at a temperature of 500-600° C. Front panel 2 needs at least twice of the baking step, and rear panel 10 needs at least four times of the baking step.

A conventional baking step is described hereinafter. FIGS. 20A and 20B show a structure of a supporting bed to be used in a conventional manufacturing method of the PDP. FIG. 20A shows a plan view and FIG. 20B shows a front view. Glass substrate 200 is placed on supporting bed 210 such that an active face thereof becomes the top face and the other side of substrate 200 contacts base 210. The active face has structural elements 220 such as respective electrodes and material layers. In this status, scratches are produced on glass substrate 200 at the surface contacting bed 210.

The scratches are caused by a difference in thermally expanded volume between bed 210 and substrate 200. To be more specific, bed 210 employs heat resistant ceramic having a thermal expansion coefficient of $-0.4\times10^{-6}$/° C., and glass substrate 200 has a thermal expansion coefficient of $8.3\times10^{-6}$/° C. Since, there is a relatively large difference between these two numbers, a large amount of difference occurs in the thermally expanded volume between bed 210 and substrate 200 when they are put into a baking furnace. The greater difference in the thermally expanded volume occurs proportionately as the substrate becomes larger. In particular, a method of taking multi-plates from one large substrate (i.e. plural PDPs are produced from one glass substrate 200) uses such a large glass substrate 200 to be baked that a greater difference in thermally expanded volume is expected. Thus substrate 200 is rubbed with bed 210, and linear scratches are produced on substrate 200. The linear scratches become longer in proportion to the size of substrate 200.

As the arrow marks in FIG. 20A indicate, glass substrate 200 thermally expands radially from thermal expansion center point 230, so that the linear scratches caused by the rubbing between substrate 200 and bed 210 run radially from center point 230. In general, in the case of glass substrate 200 formed of uniform composition, center point 230 agrees with the center of gravity of glass substrate 200, and the maximum length of the linear scratches can be calculated from the difference in the thermally expanded volume between substrate 200 and bed 210 as well as from the size of the substrate.

The maximum length of the linear scratches can be expressed in this way: (a difference in thermal expansion coefficient between glass substrate 200 and supporting bed 210)×(baking temperature)×(size of the substrate). When heat-resistant ceramic having a low thermal expansion coefficient is used as supporting bed 210, and general PDP-purpose highly distortion-resistant glass of 42" (980 mm×554 mm) is used as glass substrate 200, and these two elements are baked at 600° C., then a maximum length of 3.4 mm can be expected for the linear scratches produced on glass substrate 200. A linear scratch of not shorter than 1 mm or sometimes 0.7 mm is visible with ease, so that such scratches substantially degrade the display quality.

Figure 2A:
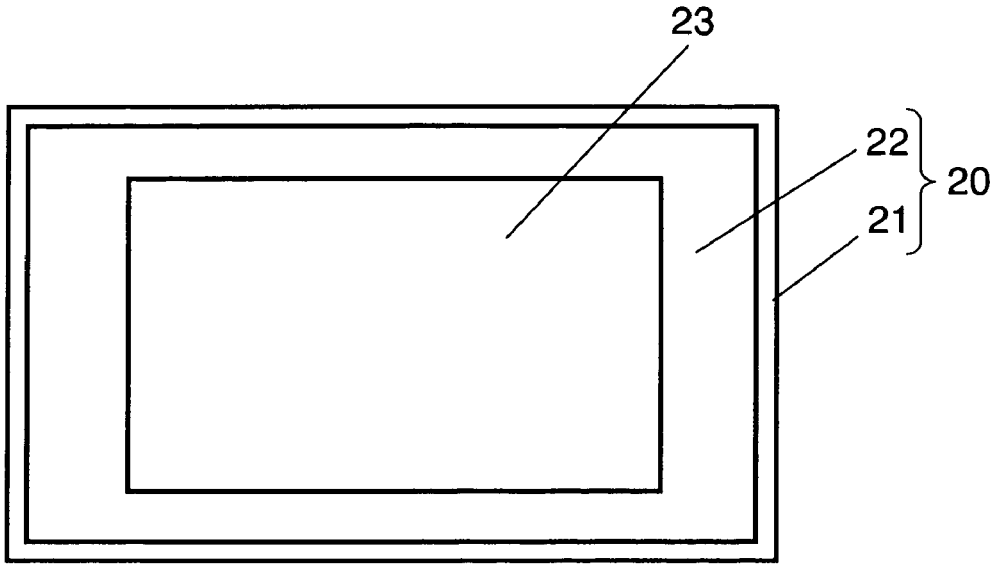
FIG. 2A shows a plan view illustrating a structure of a supporting bed to be used in a method of manufacturing a display panel in accordance with a first embodiment of the present invention.
Figure 2B:
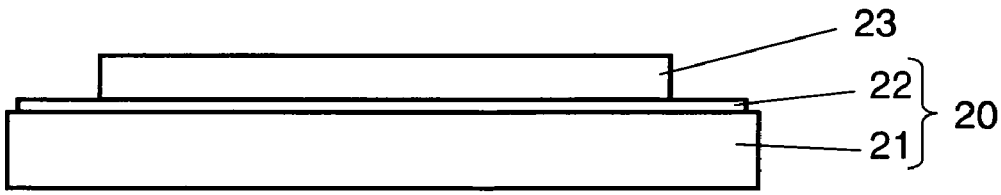
FIG. 2B shows a front view illustrating a structure of the supporting bed to be used in the method of manufacturing the display panel in accordance with the first embodiment of the present invention.

FIGS. 2A and 2B illustrate a structure of the supporting bed to be used in the method of manufacturing the display panels in accordance with the first embodiment of the present invention, and FIGS. 2A and 2B illustrate the state to put substrate on supporting bed. FIG. 2A shows a plan view and FIG. 2B shows a lateral view. As these drawings show, supporting bed 20 includes first supporting bed 21 and second supporting bed 22, and substrate 23 is placed on second supporting bed 22. Substrate 23 represents front glass substrate 3, on which the structural elements of a PDP are formed, and also rear glass substrate 11. A surface of substrate 23 contacts second supporting bed 22, and the structural elements are formed on the other side of this surface of substrate 23, which is thus placed on first supporting bed 21 via second supporting bed 22.

First supporting bed 21 uses the material having a low thermal expansion coefficient, which indicates a small value of $\alpha$ ($-0.4\times10^{-6}$/° C.). Second supporting bed 22 is made of thin metal plate. A difference in thermal expansion coefficient between second supporting bed 22 and substrate 23 is set smaller than the difference between first supporting bed 21 and substrate 23. To be more specific, the thin metal plate of second supporting bed 22 is selected such that an absolute value of the difference in thermal expansion coefficient between second supporting bed 22 and substrate 23 becomes not greater than a half of, or preferably not greater than 10% of an absolute value of the difference in thermal expansion coefficient between substrate 23 and first supporting bed 21. Titanium or titanium alloy can be used as the thin metal plate.

As shown in FIG. 2A, second supporting bed 22 is placed to exist around substrate 23, namely, the periphery of second supporting bed 22 placed on first supporting bed 21 always exists outside the periphery of substrate 23 placed on second supporting bed 22.

As discussed above, substrate 23 is placed on supporting bed 20, and the structural elements of a PDP, which elements are formed on substrate 23, are baked in the baking furnace. The prior art discussed previously puts substrate 23 directly on first supporting bed 21 for baking, and substrate 23 invites scratches on its surface contacting first supporting bed 21 due to the difference in thermally expanded volume between first supporting bed 21 and substrate 23 during the baking. The heat-resistant ceramic used as first supporting bed 21 has such a small thermal expansion coefficient, and front glass substrate 3 or rear glass substrate 11 used as substrate 23 has such a large thermal expansion coefficient, substrate 23 has an order of magnitude greater than that of the heat-resistant ceramic. Thus, there occurs a large difference in thermally expanded volume between first supporting bed 21 and substrate 23 during the baking in the baking furnace. In particular, a method of taking multi-plates from one large substrate (i.e. plural front panels 2 and rear panels 10 of PDPs are produced from one glass substrate 23) uses such large glass substrate 23 to be baked that a greater difference in thermally expanded volume between first supporting bed 21 and substrate 23 is expected. Thus, substrate 23 is rubbed with bed 21, and scratches are produced due to the difference in the thermally expanded volume.

In this embodiment of the present invention, as shown in FIG. 2, second supporting bed 22 is placed on first supporting bed 21, and substrate 23 is placed on second supporting bed 22. Then they are put into the baking furnace for baking the material layer, formed on substrate 23, of structural elements of a PDP. In this case, the difference in thermal expansion coefficient between second supporting bed 22 and substrate 23 becomes smaller than that between first supporting bed 21 and substrate 23, so that the difference in thermally expanded volume between substrate 23 and second supporting bed 22, which contacts substrate 23, becomes smaller. As a result, this structure allows suppressing the production of scratches on substrate 23.

For instance, use of a metal plate made of titanium, of which thermal expansion coefficient of $8.4\times10^{-6}$/° C., as second supporting bed 22, so that in terms of thermal expansion coefficient, bed 22 is close to substrate 23 having a thermal expansion coefficient of $8.3\times10^{-6}$/° C. At this time, the difference in thermal expansion coefficient between second supporting bed 22 and substrate 23 becomes substantially smaller than that between first supporting bed 21 and substrate 23. As a result, the length of scratches produced on substrate 23 becomes approx. two orders of magnitude smaller than the case where substrate 23 is placed on first supporting bed 21.

Additionally, in this embodiment, as shown in FIG. 2, second supporting bed 22 exists around substrate 23, in other words, the periphery of second supporting bed 22 placed on first supporting bed 21 always exists outside the edges of substrate 23 placed on second supporting bed 22. Thus if ends of the periphery of second supporting bed 22 exist inside substrate 23, scratches can be produced on substrate 23 by the ends of the periphery; however, this embodiment can prevent the scratches caused by this reason.

As discussed above, this first embodiment can suppress the production of scratches on the surface of substrate 23, which scratches are caused by the difference in thermal expansion coefficient between supporting bed 20 and substrate 23. Additionally, it can also prevent the scratches due to rubbing substrate 23 with the ends of second supporting bed 22. As a result, a quality display panel is obtainable.

Second Embodiment

The baking method demonstrated in the first embodiment, (i.e. flat substrate 23 placed on flat bed 22 is put in the baking furnace for baking,) however, expands the air between second supporting bed 22 and substrate 23, so that buoyancy occurs to substrate 23, which moves on second supporting bed 22 and sometimes invites damages. A phenomenon similar to this also occurs between first supporting bed 21 and second supporting bed 22, so that substrate 23 becomes unstable, which invites damages to itself or malfunction to the baking furnace. This second embodiment demonstrates the prevention of scratches on the surface of substrate 23 and the structure of a supporting bed which prevents damages to substrate 23.

Figure 3:
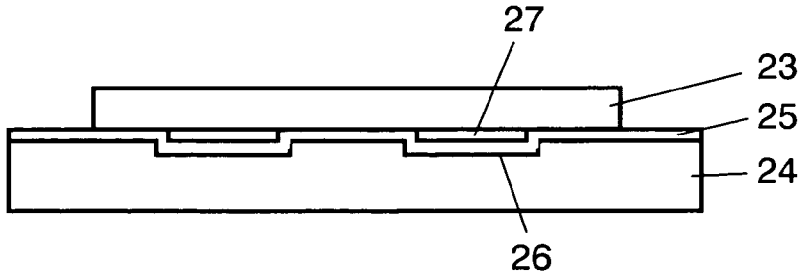
FIG. 3 shows a structure of a supporting bed to be used in a method of manufacturing a display panel in accordance with a second embodiment of the present invention.

FIG. 3 shows the structure of the supporting bed to be used in a method of manufacturing display panels in accordance with the second embodiment of the present invention, and FIG. 3 shows a substrate placed on this supporting bed. The structure of the substrate used in this second embodiment of display panel remains unchanged from that of the first embodiment, so that the description thereof is omitted here. First supporting bed 24 and second supporting bed 25 differ in structure of the counterparts used in the first embodiment.

To be more specific, grooves 26 are provided to first supporting bed 24, and second supporting bed 25 is formed of thin plate along the surface of first supporting bed 24 including grooves 26. Substrate 23 is placed on second supporting bed 25, and spaces 27 are provided between substrate 23 and second supporting bed 25. The thin plate forming second supporting bed 25 is made of metal plate similar to the one used in the first embodiment, so that the metal plate contains titanium. Second supporting bed 25 exists around substrate 23.

The second embodiment allows reducing a difference in thermally expanded volume between second supporting bed 25 and substrate 23 during the baking, thereby suppressing the production of scratches on substrate 23. Additionally, spaces 27 formed between substrate 23 and second supporting bed 25 allow reducing production of buoyancy to substrate 23 during the baking, thereby suppressing slide of substrate 23 for preventing damages of substrate 23.

Figure 4:
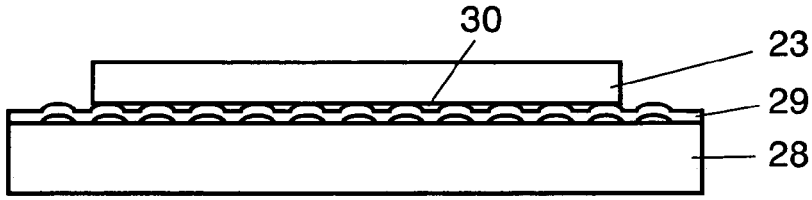
FIG. 4 shows a structure of a modified supporting bed to be used in the method of manufacturing the display panel in accordance with the second embodiment of the present invention.

FIG. 4 shows a structure of a modified supporting bed to be used in a method of manufacturing display panels in accordance with the second embodiment of the present invention. Second supporting bed 29 having bumps and dips is placed on flat surface of first supporting bed 28, so that spaces 30 are provided between substrate 23 and second supporting bed 29. Second supporting bed 29 is made of metal plate similar to the one used in the first embodiment, so that the metal plate contains titanium. Second supporting bed 29 exists around substrate 23.

As a result, the difference in thermally expanded volume between second supporting bed 29 and substrate 23 during the baking becomes smaller, thereby suppressing the production of scratches on substrate 23. Spaces 30 formed between substrate 23 and second supporting bed 29 allows reducing buoyancy to substrate 23, thereby suppressing slide of substrate 23 for preventing damages of substrate 23.

Third Embodiment

Figure 5:
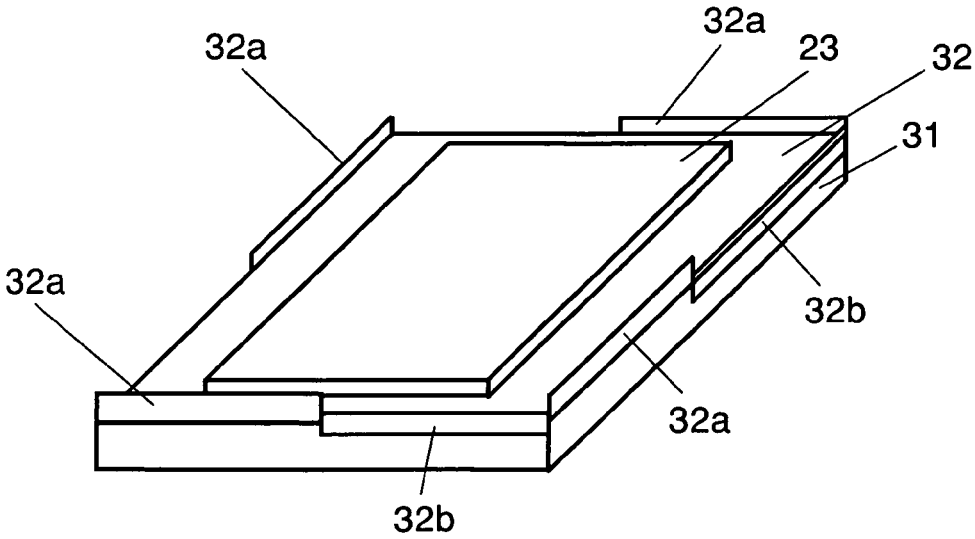
FIG. 5 shows a structure of a supporting bed to be used in a method of manufacturing a display panel in accordance with a third embodiment of the present invention.

FIG. 5 shows a structure of a supporting bed to be used in a method of manufacturing display panels in accordance with the third embodiment of the present invention. The structure of the substrate used in the third embodiment of display panel remains unchanged from that of the first embodiment, so that the description thereof is omitted here. The third embodiment employs a movement suppressing means for suppressing a move of the second supporting bed on the first supporting bed.

As shown in FIG. 5, second supporting bed 32 formed of thin plate is placed on first supporting bed 31, and substrate 23 is placed on second supporting bed 32. Second supporting bed 32 includes first bent sections 32*a* bent upward and second bent sections 32*b* bent downward. Second bent sections 32*b* work as the movement suppressing means. Second bent sections 32*b* are provided such that they confront respectively four lateral faces of first supporting bed 31, so that second supporting bed 32 can be prevented from sliding on first supporting bed 31. The presence of first bent sections 32*a* allows preventing substrate 23 from sliding in a large amount. Second supporting bed 32 is made of metal plate containing titanium similar to that described in the first embodiment.

The foregoing structure allows reducing a difference in thermally expanded volume between second supporting bed 32 and substrate 23, thereby suppressing the production of scratches on substrate 23 during the baking. Further, this structure allows suppressing slide of second supporting bed 32 or substrate 23 during the baking, thereby preventing damages of substrate 23 and malfunction of the baking furnace.

Figure 6A:
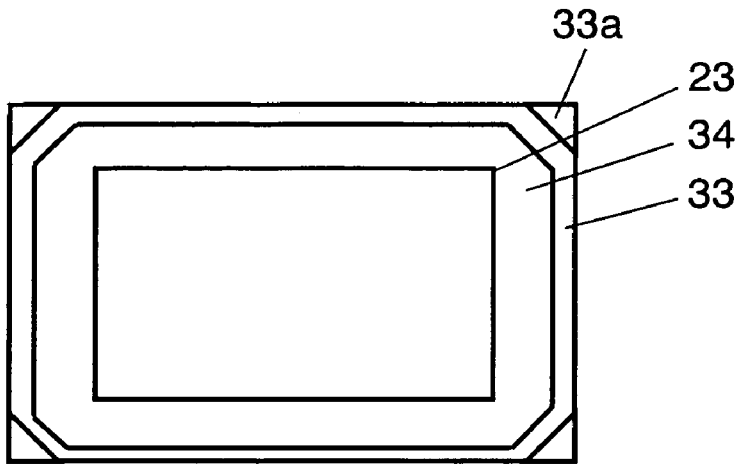
FIG. 6A shows a plan view illustrating a structure of a modified supporting bed to be used in the method of manufacturing the display panel in accordance with the third embodiment of the present invention.
Figure 6B:
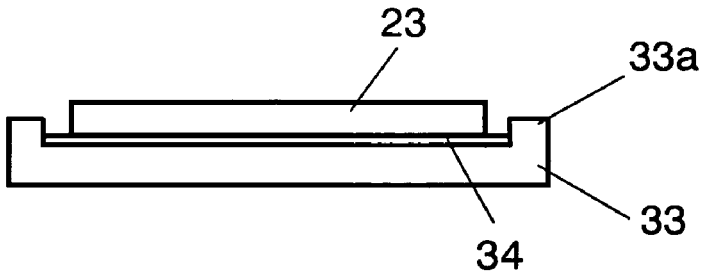
FIG. 6B shows a front view illustrating a structure of the modified supporting bed to be used in the method of manufacturing the display panel in accordance with the third embodiment of the present invention.

FIGS. 6A and 6B show a structure of a modified supporting bed to be used in a method of manufacturing display panels in accordance with the third embodiment of the present invention. As shown in FIGS. 6A and 6B, second supporting bed 34 formed of thin plate is placed on first supporting bed 33, and substrate 23 is placed on second supporting bed 34. First supporting bed 34 has four projections 33*a* at its corners respectively, and each one of projections 33*a* shows a right-angled triangle in a plan view. Second supporting bed 34 shapes like a rectangle with its four corners being cut, and each one of the cut corners confronts the hypotenuse of each one of the right-angled triangle. This structure allows preventing second supporting bed 34 from sliding and deviating from its position on first supporting bed 33. Second supporting bed 34 is formed of metal plate containing titanium similar to that used in the first embodiment, so that the difference in thermally expanded volume between second supporting bed 34 and substrate 23 during the baking becomes small. As a result, the production of scratches on substrate 23 can be suppressed.

Figure 7A:
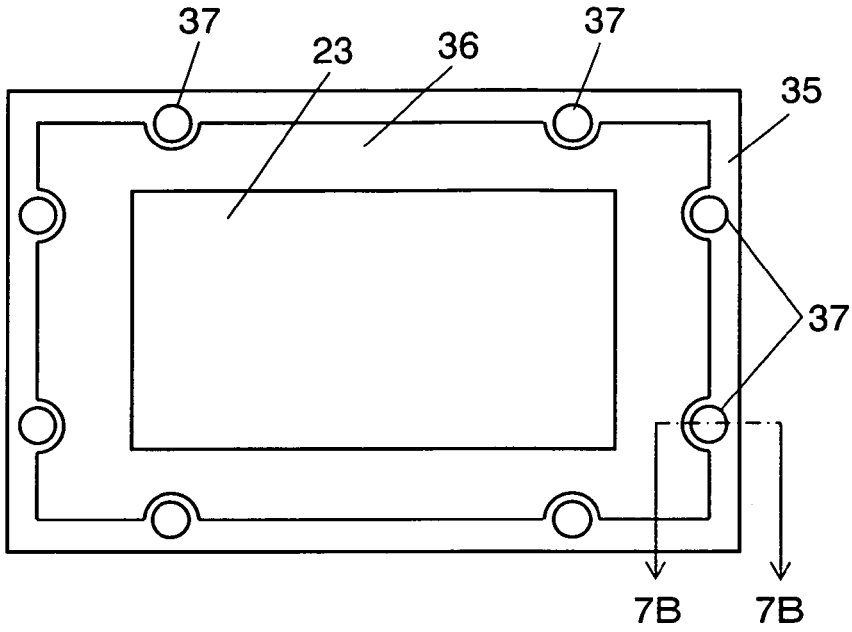
FIG. 7A shows a plan view illustrating a structure of another modified supporting bed to be used in the method of manufacturing the display panel in accordance with the third embodiment of the present invention.
Figure 7B:
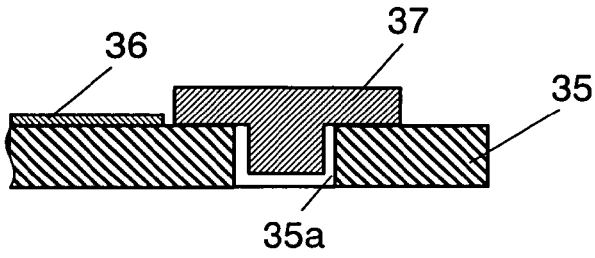
FIG. 7B shows a sectional view taken along line 7B-7B of FIG. 7A.

FIGS. 7A and 7B show a structure of another modified supporting bed to be used in a method of manufacturing display panels in accordance with the third embodiment of the present invention. FIG. 7A shows a plan view and FIG. 7B shows a sectional view taken along line 7B-7B of FIG. 7A. As shown in FIGS. 7A and 7B, second supporting bed 36 is placed on first supporting bed 35, and substrate 23 is placed on second supporting bed 36.

Plural holes 35*a* are provided to first supporting bed 35 such that holes 35*a* surround second supporting bed 36, and as shown in FIG. 7A, two holes 35*a* are provided to each side of the thin plate forming second supporting bed 36. Fixing members 37 are fitted into each one of holes 35*a*, and each one of members 37 works as the movement suppressing means. Fixing member 37 prevents second supporting bed 36 from sliding on first supporting bed 35 during the baking, and if substrate deviates from its position in a great amount, fixing member 37 works as a stopper to substrate 23. Second supporting bed 36 is made of metal plate, containing titanium, similar to the one used in the first embodiment, so that the difference in thermally expanded volume between second supporting bed 36 and substrate 23 during the baking becomes smaller, thereby suppressing the production of scratches on substrate 23. Considering the thermal expansion, a space is provided between second supporting bed 36 and fixing members 37.

Figure 8A:
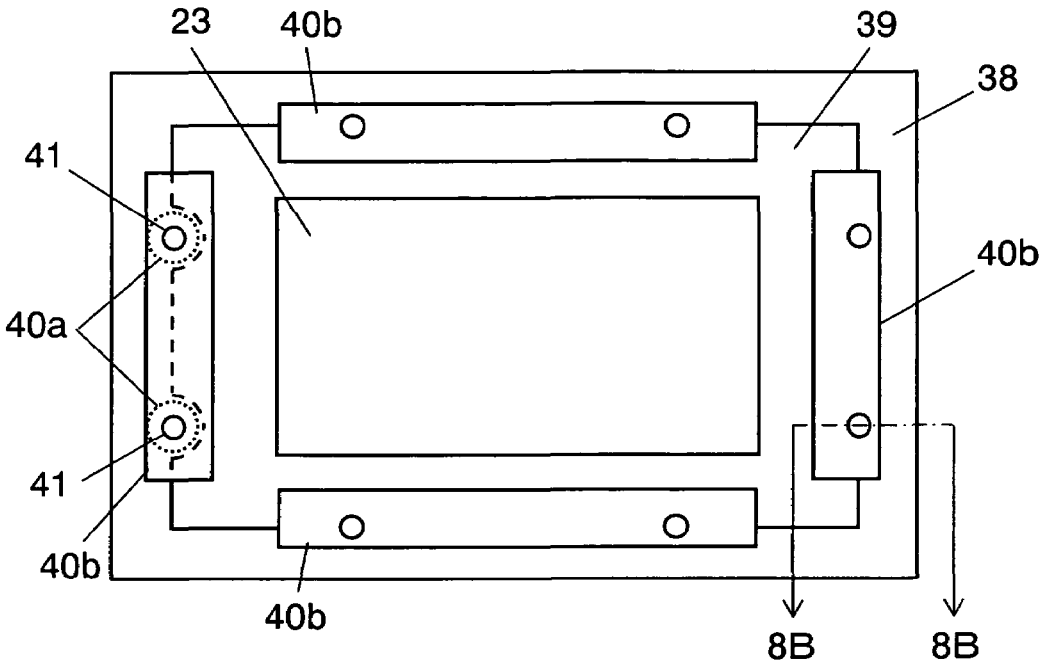
FIG. 8A shows a plan view illustrating a structure of another modified supporting bed to be used in the method of manufacturing the display panel in accordance with the third embodiment of the present invention.
Figure 8B:
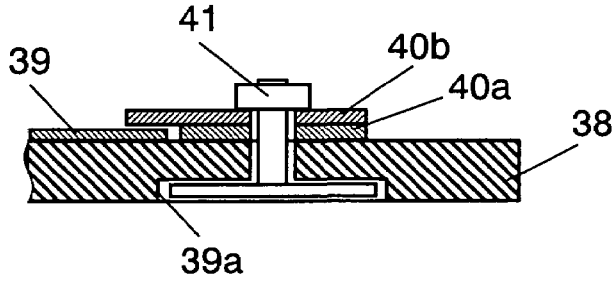
FIG. 8B shows a sectional view taken along line 8B-8B of FIG. 8A.

FIGS. 8A and 8B show a structure of another modified supporting bed to be used in a method of manufacturing display panels in accordance with the third embodiment of the present invention. FIG. 8A shows a plan view and FIG. 8B shows a sectional view taken along line 8B-8B of FIG. 8A. As shown in FIGS. 8A and 8B, second supporting bed 39 is placed on first supporting bed 38, and substrate 23 is placed on second supporting bed 39.

Plural holes 39*a* are provided to first supporting bed 38 such that holes 39*a* surround second supporting bed 39, and as shown in FIG. 8A, two holes 39*a* are provided to respective sides of second supporting bed 39. Plate-like members 40*a*, 40*b* working as movement suppressing means are respectively provided corresponding to respective sides of bed 39. Plate-like members 40*a*, 40*b* are fixed to first supporting bed 38 at holes 39*a* with fixing member 41. Plate-like member 40*a* is placed around second supporting bed 39, and member 40*b* is overlaid on member 40*a* such that the ends of member 40*b* are overlaid on the ends of second supporting bed 39. These plate-like members 40*a*, 40*b* prevent second supporting bed 39 from deviating from its position, by sliding on first supporting bed 38 during the baking. Members 40*b* also work as stoppers to substrate 23 if substrate 23 deviates from its position in a great amount. Second supporting bed 39 is made of metal plate containing titanium similar to the one used in the first embodiment, so that the difference in thermally expanded volume between second supporting bed 39 and substrate 23 during the baking becomes smaller, thereby suppressing the production of scratches on substrate 23. Plate-like members 40*a* and 40*b* can be integrated into one body. Considering thermal expansion, spaces are provided between second supporting bed 39 and plate-like member 40*a*. Member 40*a* has a greater thickness than second supporting bed 39 so that a space is prepared between the underside of plate-like member 40*b* and a top face of second supporting bed 39, thus allowing second supporting bed 39 to be thermally expanded.

Figure 9A:
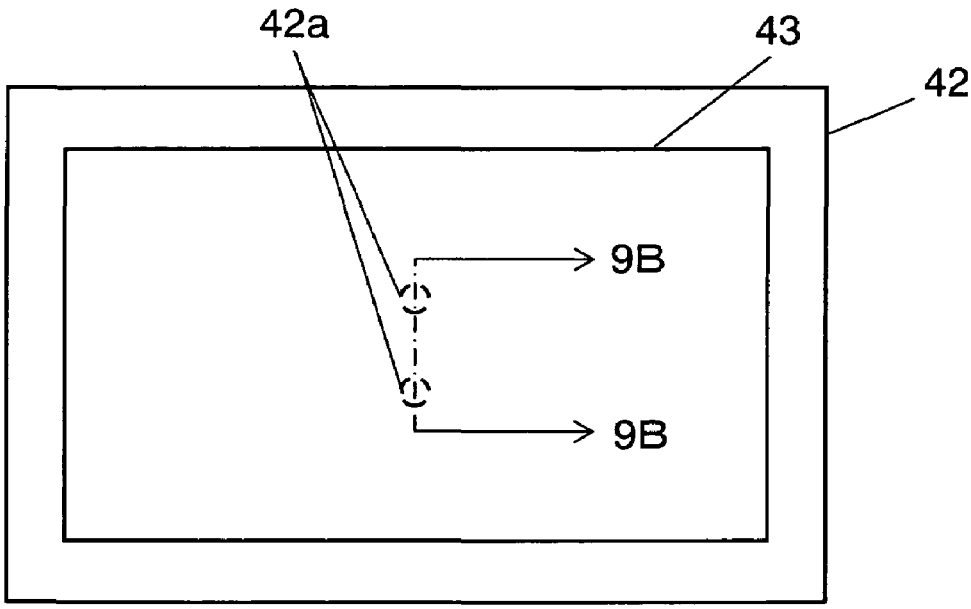
FIG. 9A shows a plan view illustrating a structure of a modified supporting bed to be used in the method of manufacturing the display panel in accordance with the third embodiment of the present invention.
Figure 9B:
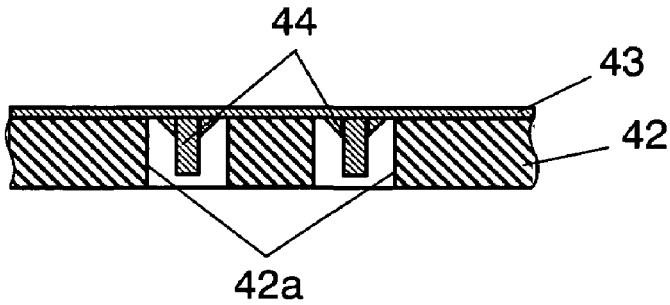
FIG. 9B shows a sectional view taken along line 9B-9B of FIG. 9A.

FIGS. 9A and 9B show a structure of a modified supporting bed to be used in a method of manufacturing display panels in accordance with the third embodiment of the present invention. FIG. 9A shows a plan view and FIG. 9B shows a sectional view taken along line 9B-9B of FIG. 9A. As shown in FIGS. 9A and 9B, second supporting bed 43 is placed on first supporting bed 42. Although this is not shown in the drawings, substrate 23 smaller than second supporting bed 43 is placed on second supporting bed 43.

As shown in FIGS. 9A and 9B, two holes 42*a* are provided to the center section of first supporting bed 42. FIG. 9A shows these two holes 42*a* are arranged to be in parallel with the short side of first supporting bed 42. Projections 44 working as movement suppressing means are mounted to the underside of second supporting bed 43 formed of thin plate. Projections 44 correspond to holes 42*a*, and they are to be fitted to holes 42*a* of first supporting bed 42. Presence of projections 44 allows preventing second supporting bed 43 from deviating from the position by sliding on first supporting bed 42 or from moving by rotating on first supporting bed 42 during the baking. Second supporting bed 43 is made of metal plate, containing titanium, similar to the one used in the first embodiment, so that the difference in thermally expanded volume between second supporting bed 43 and substrate 23 during the baking becomes smaller, thereby suppressing the production of scratches on substrate 23. The number of and the places of projections 44 can be arbitrarily determined; however, the presence of at least two projections 44 can prevent second supporting bed 43 from rotating or parallel displacement.

Figure 10A:
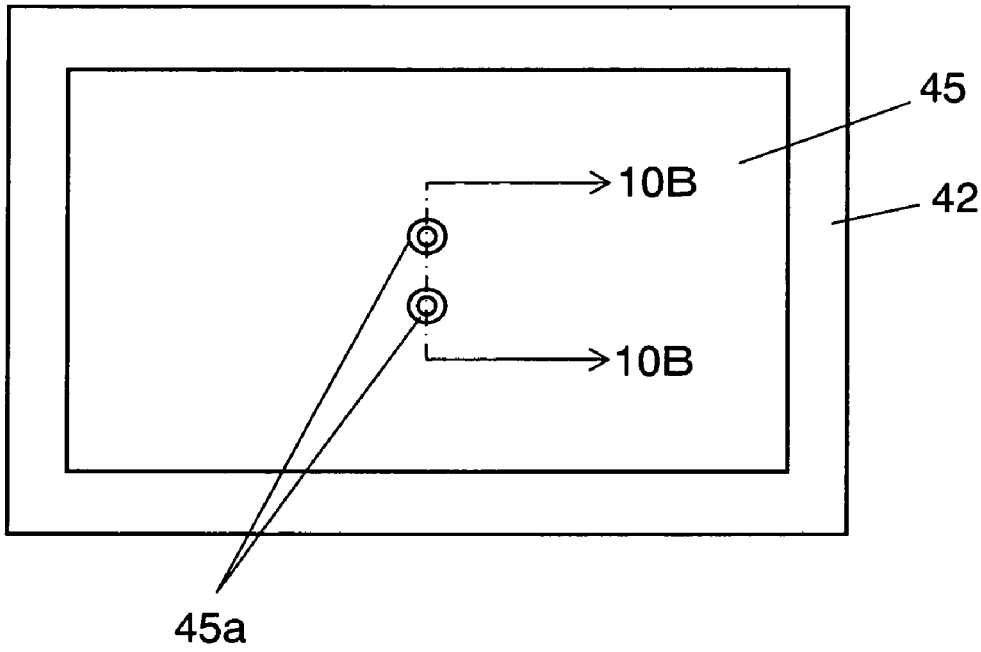
FIG. 10A shows a plan view illustrating a structure of another modified supporting bed to be used in the method of manufacturing the display panel in accordance with the third embodiment of the present invention.
Figure 10B:
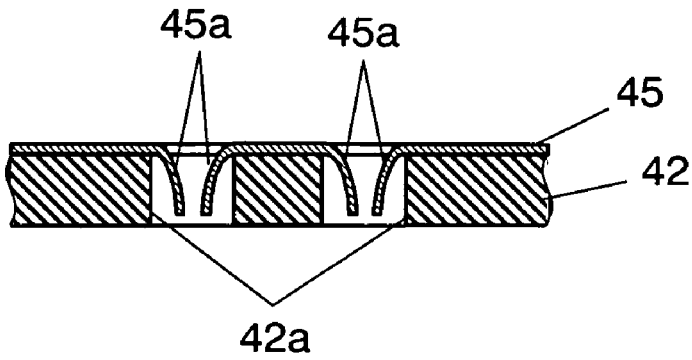
FIG. 10B shows a sectional view taken along line 10B-10B of FIG. 10A.

FIGS. 10A and 10B show a structure of a modified supporting bed to be used in a method of manufacturing display panels in accordance with the third embodiment of the present invention. FIG. 10A shows a plan view and FIG. 10B shows a sectional view taken along line 10B-10B of FIG. 10A. As shown in FIGS. 10A and 10B, second supporting bed 45 is placed on first supporting bed 42. Although this is not shown in the drawing, substrate 23 smaller than second supporting bed 45 is placed on second supporting bed 45.

As shown in FIGS. 10A and 10B, two holes 42*a* are provided to the center section of first supporting bed 42. FIG. 10A shows that these two holes 42*a* are arranged to be in parallel with the short side of first supporting bed 42. Two projections 45*a* working as movement suppressing means are provided at a center section of the underside of second supporting bed 45. These projections 45*a* can be formed by making cuts on second supporting bed 45 formed of thin plate, and bending the cuts downward. If the face, on which substrate 23 is placed, has some sharply pointed sections thereon, the pointed sections tend to invite scratches on substrate 23. The cuts on second supporting bed 45 can be moderately bent so that no sharply pointed sections can occur on the face. Projections 45*a* fit into holes 42*a* on first supporting bed 42.

Similar to the case shown in FIGS. 9A and 9B, the presence of projections 45*a* allows preventing second supporting bed 45 from deviating from the position by sliding on first supporting bed 42 or from moving by rotating on first supporting bed 42. Second supporting bed 45 is made of metal plate, containing titanium, similar to the one used in the first embodiment, so that the difference in thermally expanded volume between second supporting bed 45 and substrate 23 during the baking becomes smaller, thereby suppressing the production of scratches on substrate 23. The number of and the places of projections 45*a* can be arbitrarily determined; however, at least two projections 45*a* can prevent second supporting bed 45 from rotating or parallel displacement.

In the first through the third embodiments, substrate 23 is preferably placed on the second supporting bed such that the center point of substrate 23 agrees with the center point of second supporting bed. This placement allows a thermally expanding direction of substrate 23 to agree with that of the second supporting bed. If substrate 23 is larger than the second supporting bed, substrate 23 touches the edges of the second supporting bed, so that scratches tend to occur on substrate 23. However, in the first through the third embodiments, since substrate 23 is placed on the second supporting bed such that the second supporting bed exists around substrate 23, such scratches never occur.

Fourth Embodiment

The fourth embodiment of the present invention is demonstrated hereinafter with reference to the accompanying drawings. In the first through the third embodiments previously discussed, the second supporting bed formed of thin plate is used; however, this fourth embodiment uses a bar-like member as the second supporting bed.

Figure 11A:
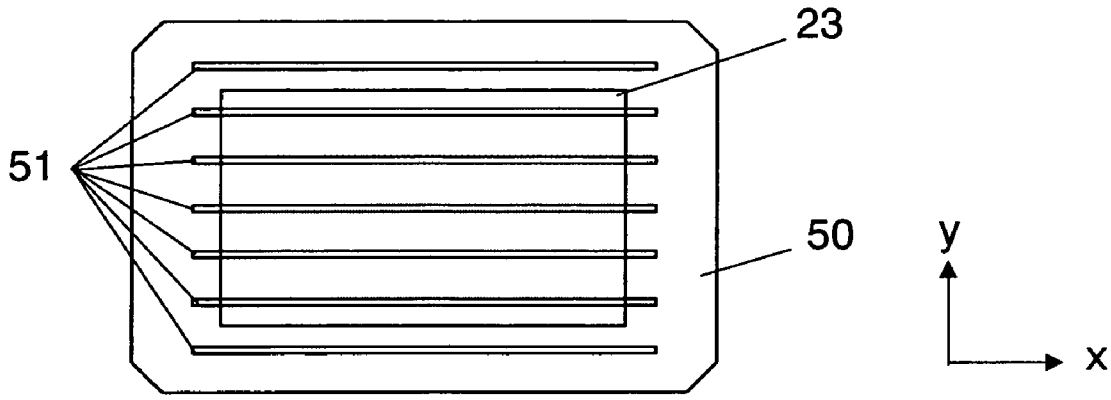
FIG. 11A shows a plan view illustrating a structure of a supporting bed to be used in a method of manufacturing a display panel in accordance with a fourth embodiment of the present invention.
Figure 11B:
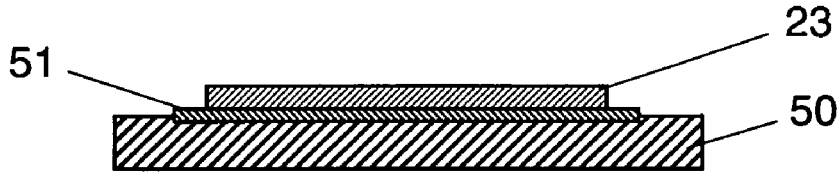
FIG. 11B shows a sectional view taken along the x direction in FIG. 11A.
Figure 11C:
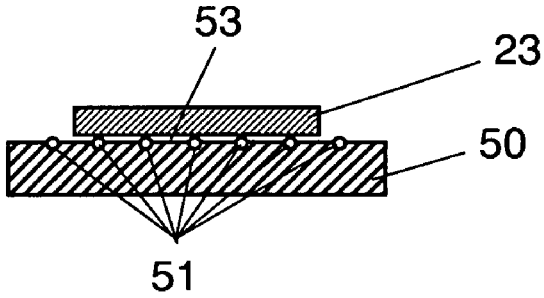
FIG. 11C shows a sectional view taken along the y direction in FIG. 11A.

FIGS. 11A, 11B and 11C show a structure of a supporting bed to be used in a method of manufacturing display panels in accordance with the fourth embodiment of the present invention, and these drawings show a substrate placed on the supporting bed. The substrate of PDP has a structure similar to that described in the first embodiment, so that the descriptions thereof is omitted here. In this fourth embodiment, the structure of the second supporting bed differs from those used in the first and the second embodiments.

FIG. 11A shows a plan view, and FIG. 11B shows a sectional view taken along the x direction in FIG. 11A. FIG. 11C shows a sectional view taken along the y direction in FIG. 11A. As shown in FIGS. 11A, 11B and 11C, first supporting bed 50 has plural grooves in striped pattern formed thereon in parallel with each other, and bar-like members 51 working as the second supporting bed are inserted in the grooves. Substrate 23 is placed on bar-like members 51 working as the second supporting bed, and in this status, spaces 53 are formed between substrate 23 and first supporting bed 50, namely, bar-like members 51 lie between first supporting bed 50 and substrate 23. First supporting bed 50 is made of material having a low thermal expansion coefficient such as heat-resistant ceramic similar to the first through the third embodiments. Bar-like member 51 as the second supporting bed is made of same metal as thin metal plate for the second supporting bed similar to the first through the third embodiment, and the metal contains, e.g. titanium or titanium alloy.

In the embodiment shown in FIGS. 11A, 11B and 11C, first supporting bed 50 is put into the baking furnace for baking a material layer formed on substrate 23. In this case, a difference in thermal expansion coefficient between bar-like member 51 and substrate 23 is so small that a difference in thermally expanded volume during the baking between member 51 and substrate 23 becomes small, thereby suppressing the production of scratches on substrate 23. The presence of spaces 53 between substrate 23 and first supporting bed 50 allows reducing the production of buoyancy to substrate 23 during the baking, thereby preventing substrate 23 from deviating from the position.

Figure 12A:
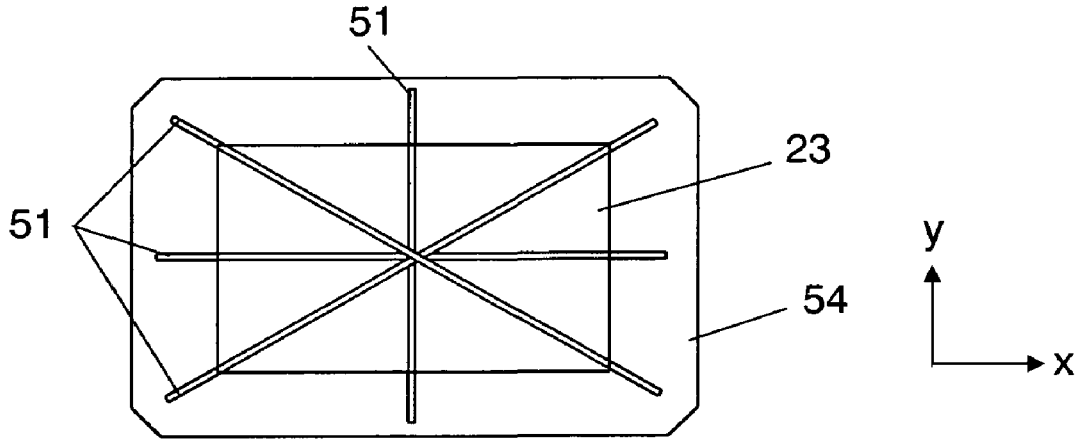
FIG. 12A shows a plan view illustrating a structure of a modified supporting bed to be used in the method of manufacturing the display panel in accordance with the fourth embodiment of the present invention.
Figure 12B:
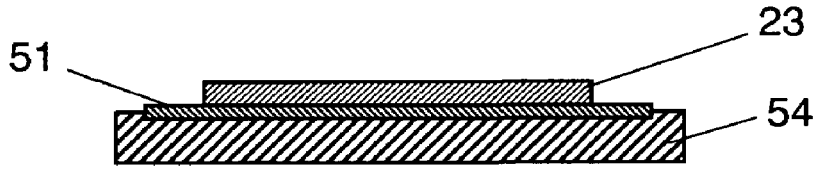
FIG. 12B shows a sectional view taken along the x direction in FIG. 11A.

FIGS. 12A and 12B show a structure of a modified supporting bed to be used in a method of manufacturing display panels in accordance with the fourth embodiment of the present invention. FIG. 12A shows a plan view, and FIG. 12B shows a sectional view taken along the x direction in FIG. 12A.

As shown in FIGS. 12A and 12B, first supporting bed 54 has plural grooves formed radially from the center of first supporting bed 54 and on the surface thereof. Bar-like members 51 working as the second supporting bed are inserted in the grooves. When substrate 23 is placed on bar-like members 51, spaces (not shown) are formed between substrate 23 and first supporting bed 54. In FIGS. 12A and 12B, considering the thermal expansion of substrate 23 in a radial direction during the baking, bar-like members 51 are placed. According to this structure, a difference in thermal expansion coefficient between bar-like member 51 and substrate 23 is small, so that a difference in thermally expanded volume between them becomes small. Additionally, these two elements are thermally expanded in the same direction, thereby suppressing the production of scratches on substrate 23. The presence of spaces between substrate 23 and first supporting bed 54 allows reducing buoyancy to substrate 23 during the baking, so that deviation from the position of substrate 23 can be suppressed.

Figure 13A:
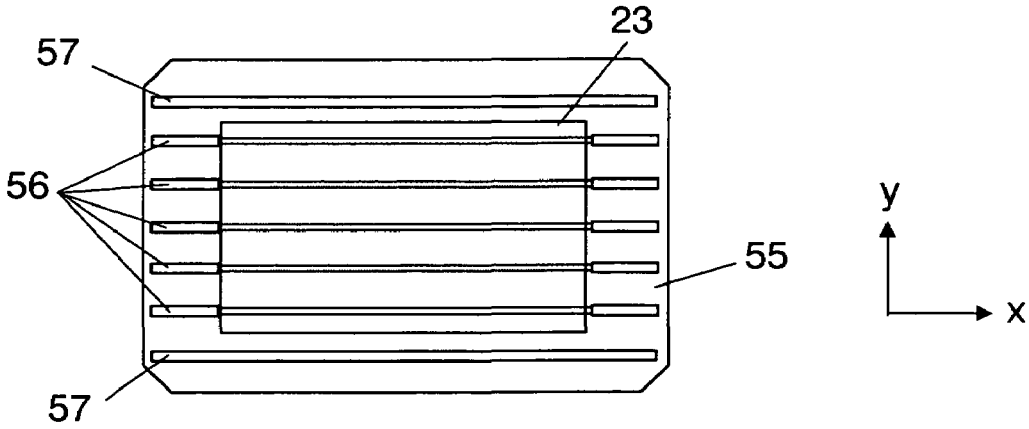
FIG. 13A shows a plan view illustrating a structure of another modified supporting bed to be used in the method of manufacturing the display panel in accordance with the fourth embodiment of the present invention.
Figure 13B:
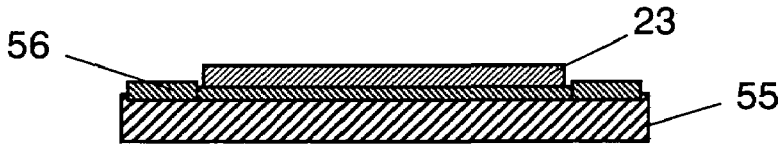
FIG. 13B shows a sectional view taken along the x direction in FIG. 13A.
Figure 13C:
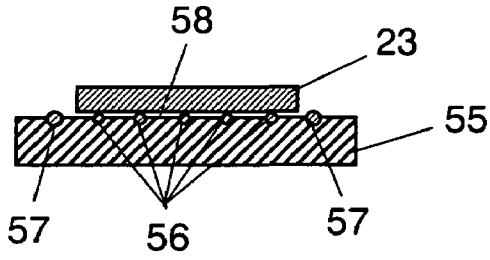
FIG. 13C shows a sectional view taken along the y direction in FIG. 13A.

FIGS. 13A, 13B, and 13C show a structure of another modified supporting bed to be used in a method of manufacturing display panels in accordance with the fourth embodiment of the present invention. FIG. 13A shows a plan view, FIG. 13B shows a sectional view taken along the x direction in FIG. 13A, and FIG. 13C shows a sectional view taken along the y direction in FIG. 13A.

As shown in FIGS. 13A, 13B, and 13C, first supporting bed 55 has plural grooves in striped pattern formed thereon in parallel with each other, and bar-like members 56,57 working as the second supporting bed are inserted in the grooves. Substrate 23 is placed on bar-like members 56, and in this status, spaces 58 are formed between substrate 23 and first supporting bed 55. Both ends of each one of bar-like members 56 are thicker than the other part of member 56, and the substrate 23 is placed on the thin part of bar-like member 56 is placed on substrate 23. This structure allows preventing substrate 23 from sliding along the x direction during the baking. Bar-like members 57 placed on the upper end and the lower end respectively of first supporting bed 55 shown in FIG. 13A are thick enough to prevent substrate 23 from moving along the y direction.

First supporting bed 55 is made of material having a low thermal expansion coefficient such as heat-resistant ceramic, and bar-like members 56, 57 are made of the same metal as bar-like member 51. This structure allows reducing a difference in thermal expansion coefficient between bar-like member 56, 57 and substrate 23 to small, so that a difference in thermally expanded volume between them becomes small. The production of scratches on substrate 23 can be thus further suppressed. The presence of spaces 58 between substrate 23 and first supporting bed 55 allows reducing buoyancy to substrate 23 during the baking, so that deviation from the position of substrate 23 can be suppressed.

Fifth Embodiment

Figure 14A:
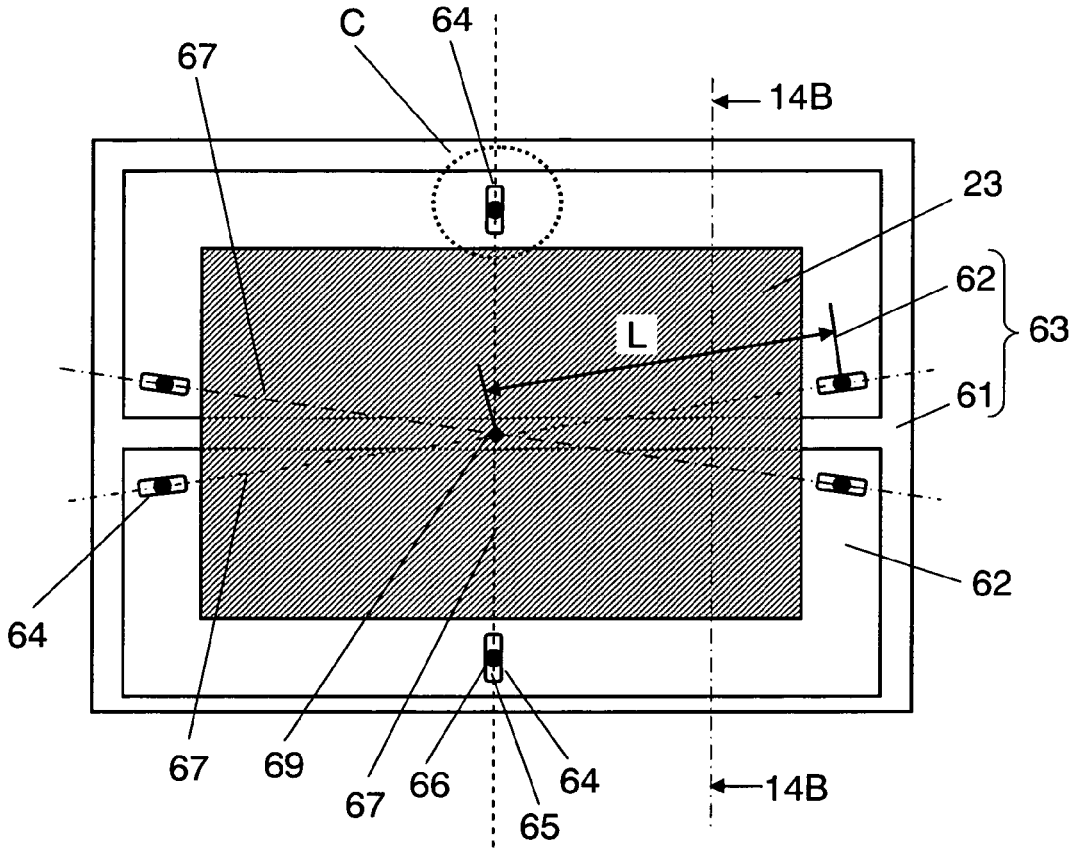
FIG. 14A shows a plan view illustrating a structure of a supporting bed to be used in a method of manufacturing a display panel in accordance with a fifth embodiment of the present invention.
Figure 14B:
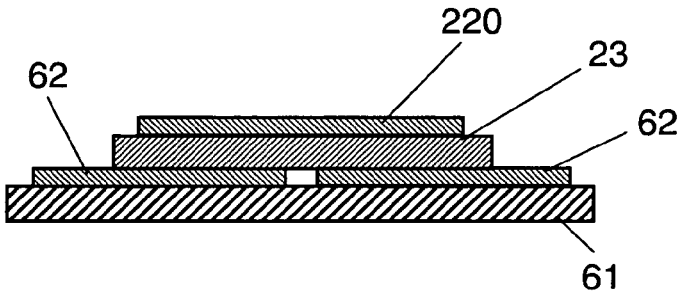
FIG. 14B shows a sectional view taken along line 14B-14B of FIG. 14A.
Figure 15A:
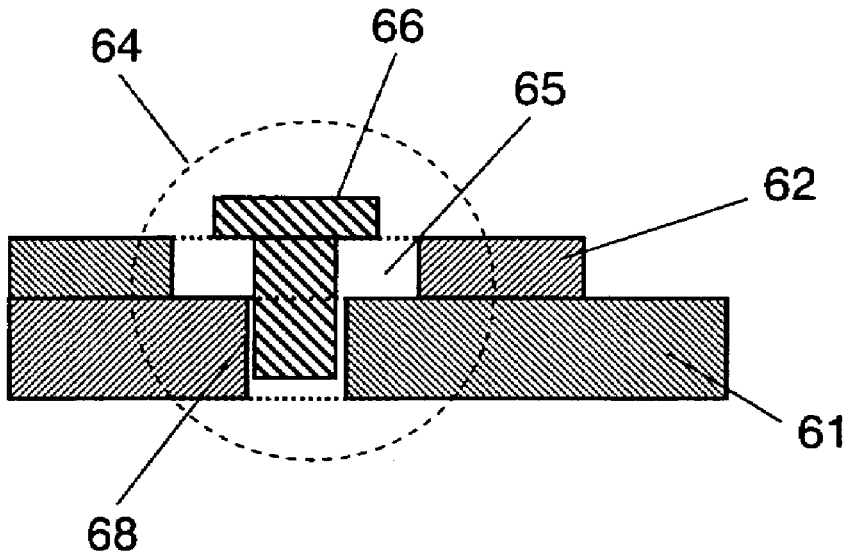
FIG. 15A shows a sectional view detailing section "C" shown in FIG. 14A.
Figure 15B:
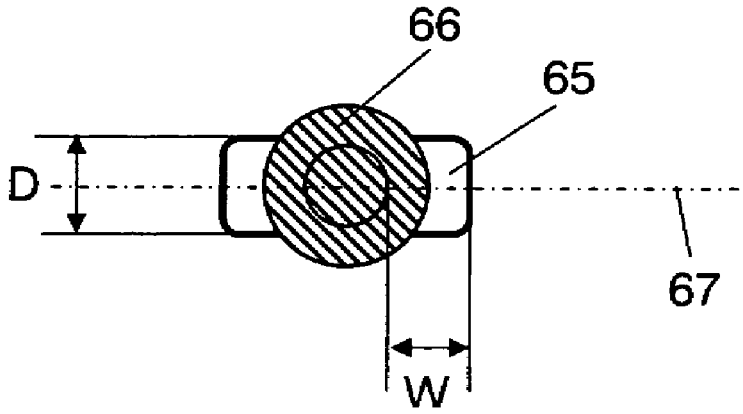
FIG. 15B shows a plan view detailing section "C" shown in FIG. 14A.

FIGS. 14A, 14B show a structure of a supporting bed to be used in a method of manufacturing display panels in accordance with the fifth embodiment of the present invention. FIG. 14A shows a plan view, and FIG. 14B shows a sectional view taken along line 14B-14B of FIG. 14A. FIG. 15A shows a sectional view detailing section "C" shown in FIG. 14A, and FIG. 15B shows a plan view of the detailed section "C".

As shown in FIG. 14B, substrate 23 is placed on supporting bed 63 formed of first supporting bed 61 and second supporting bed 62. Substrate 23 includes rear glass substrate 11 and front glass substrate 3 having structural elements, such as various electrode layers and material layers, formed thereon, i.e. on a top face of substrate 23. Second supporting bed 62 is split into two parts, and a sheet of substrate 23 is placed on second supporting bed 62 such that substrate 23 straddles the two parts of second supporting bed 62. First supporting bed 61 is made of heat-resistant material having a thermal expansion coefficient of approx. $-0.4\times10^{-6}/°$ C. Second supporting bed 62 is made of thin metallic plate containing, e.g. titanium or titanium alloy similar to the one used in the first through the third embodiments.

Second supporting bed 62 is split into two parts for the following reason: PDPs have been upsized recently, and the multiple-panel manufacturing method is employed for improving the productivity. These situations allow substrate 23 to be upsized in the baking step, so that second supporting bed 62 of extraordinary large size is needed. However, the available quantity of such a large supporting bed 62 made of a large metal plate is limited on the market, so that the cost of bed 62 becomes substantially expensive. The fifth embodiment of the present invention thus employs plural and yet small sized second supporting beds 62 in order to reduce the cost and simplifying the operation in the baking step.

As shown in FIGS. 14A and 14B, plural regulating sections 64 are provided around second supporting bed 62 made of a thin metal plate for regulating the direction of thermal expansion of bed 62. As shown in FIGS. 14A, 14B, 15A and 15B, each one of regulating sections 64 is formed of opening 65 provided to second supporting bed 62 and regulating pin 66 fixed onto first supporting bed 61. Opening 65 shapes like a rectangle having a long axis.

As FIG. 14A shows, opening 65 provided to second supporting bed 62 at regulating section 64 is formed such that center line 67 of the long axis runs through center point 69 of first supporting bed 61. Regulating pin 66 is made of heat-resistant material such as ceramic. FIG. 15A shows a status where regulating pin 66 is inserted in hole 68 provided to first supporting bed 61; however, the regulating pins can be provided to second supporting bed 62 such that the pins are movable along the longitudinal direction of openings provided to first supporting bed 61.

Figure 16:
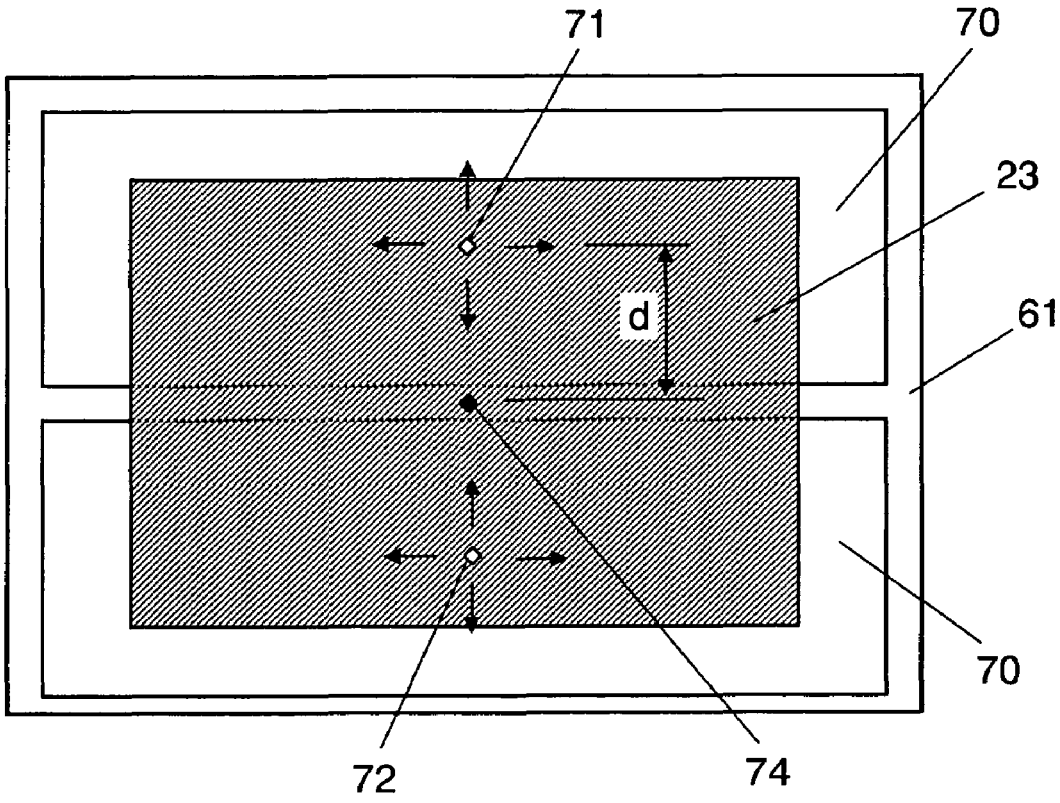
FIG. 16 shows a plan view illustrating a structure of a supporting bed without a regulating section to be used in the method of manufacturing the display panel in accordance with the fifth embodiment of the present invention.

FIG. 16 shows a structure of a supporting bed having no regulating sections. Two units of second supporting bed 70 having no regulating sections are placed side by side on first supporting bed 61, and substrate 23 is placed on the two beds 70. These two beds 70 thermally expand from their gravity centers 71, 72 as the centers of expansion. In other words, the thermal expansion causes no displacement at the gravity center of second supporting bed 70, but produces displacement radially along the arrow mark running from the gravity center. Substrate 23 straddling the two units of second supporting bed 70 thermally expands from its gravity center 74 as an expansion center regardless of the presence of beds 70, so that gravity center 74 of substrate 23 does not agree with gravity centers 71, 72 of beds 70. Use of two second supporting beds 70 causes the rubbing between beds 70 and substrate 23 during the baking, so that scratches are produced on the surface of substrate 23.

In the foregoing case, the maximum scratch length $S_{max}$ can be approximately expressed by the following equation (1):

$$S_{max}=2\times(\text{difference in thermal expansion coefficient between the substrate and the second supporting bed})\times Tf\times d \quad (1)$$

where, Tf=baking temperature, d=distance in thermal expansion center points between the substrate and the second supporting bed.

Heat-resistant ceramic is used as first supporting bed 61, and highly distortion-resistant glass for PDP of 42" size is used as substrate 23, and they are baked at 600° C., then the maximum scratch length produced on substrate 23 becomes approx. 1.4 mm.

According to the fourth embodiment of the present invention, as shown in FIG. 14A, the displacement of each one of second supporting beds 62 placed on first supporting bed 61 is limited to along the longitudinal direction of opening 65 by regulating pins 66 and opening 65 of regulating section 64. In other words, opening 65 provided to second supporting bed 62 is formed such that center line 67 of the long axis of opening 65 runs through center point 69 of first supporting bed 61. Since substrate 23 is formed of a single sheet, its thermal expansion center point agrees with center point 69 of first supporting bed 61.

Second supporting bed 62 is thus regulated its thermal expansion from center point 69 along the longitudinal direction of opening 65, so that the expanding direction of substrate 23 can agree with that of second supporting bed 62. Second supporting bed 62 is made of material, such as titanium, having a greater thermal expansion coefficient than first supporting bed 61, so that a difference in thermally expanded volume between bed 62 and substrate 23 can become smaller. As a result, the production of scratches on substrate 23 due to the rubbing between substrate 23 and bed 62 can be suppressed, or a length of scratches can be shorter. The quality of front panel 2 and rear panel 10, and the yield of these two panels can be thus improved.

Since second supporting bed 62 is split into plural beds, a larger sized glass substrate due to the multiple-panel method is applicable to this second supporting beds as they are small as are, so that the cost can be reduced.

Sixth Embodiment

Figure 17:
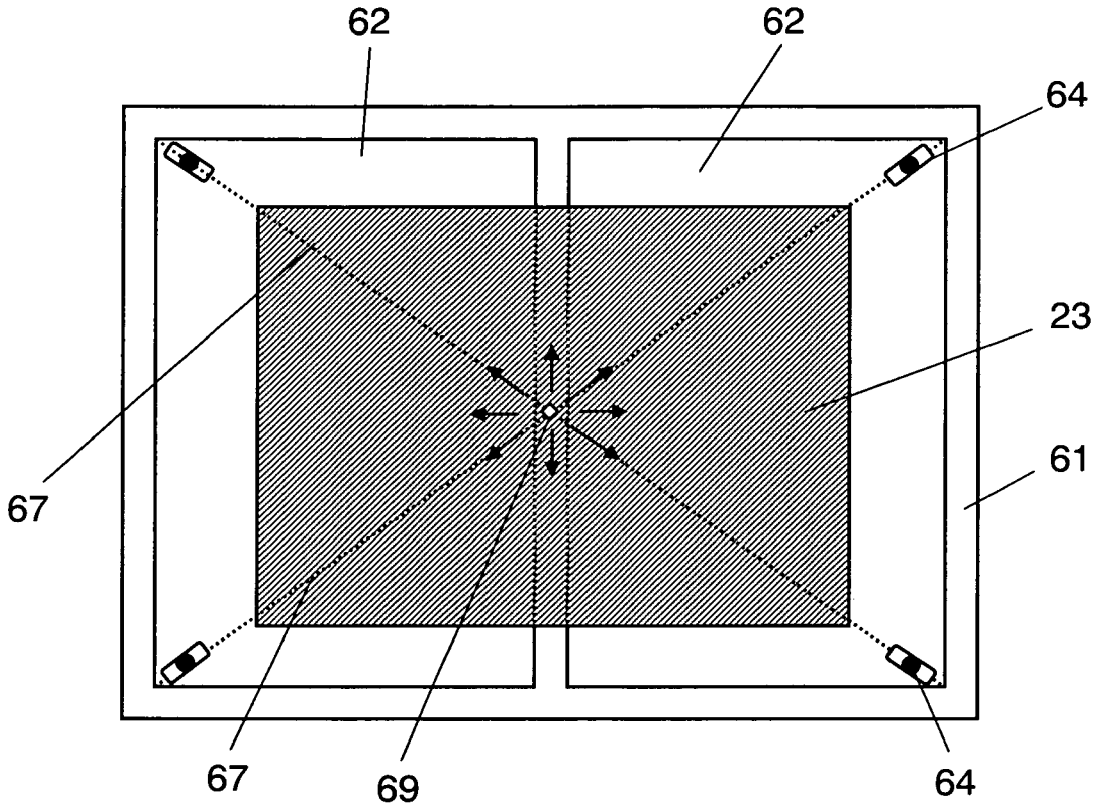
FIG. 17 shows a plan view illustrating a structure of a supporting bed to be used in a method of manufacturing a display panel in accordance with a sixth embodiment of the present invention.

FIG. 17 shows a structure of a supporting bed to be used in a method of manufacturing display panels in accordance with the sixth embodiment of the present invention. As shown in FIG. 17, two units of second supporting bed 62 are placed side by side along the long side of first supporting bed 61. Substrate 23 straddles these two units. The method of forming the structural elements of PDP on substrate 23 remains unchanged from the method described in the embodiments previously discussed, so that the description thereof is omitted here. In this sixth embodiment, regulating sections 64 similar to those in the fifth embodiment are provided to corners of second supporting bed 62, which corners correspond to the four corners of first supporting bed 61. Openings 65 of regulating sections 64 provided to second supporting bed 62 are formed such that the center line of the long axis of each opening 65 runs through center point 69 of first supporting bed 61.

The foregoing structure in accordance with the sixth embodiment allows regulating the thermal expanding direction of second supporting bed 62 to be along the thermal expanding direction of substrate 23 during the baking, so that rubbing between substrate 23 and second supporting bed 62 can be reduced. As a result, the production of scratches on substrate 23 can be further suppressed.

In the fifth and the sixth embodiments, two units of second supporting bed are used; however, e.g. four units of the second supporting bed can be used for reducing the cost of the second supporting bed.

Seventh Embodiment

Figure 18:
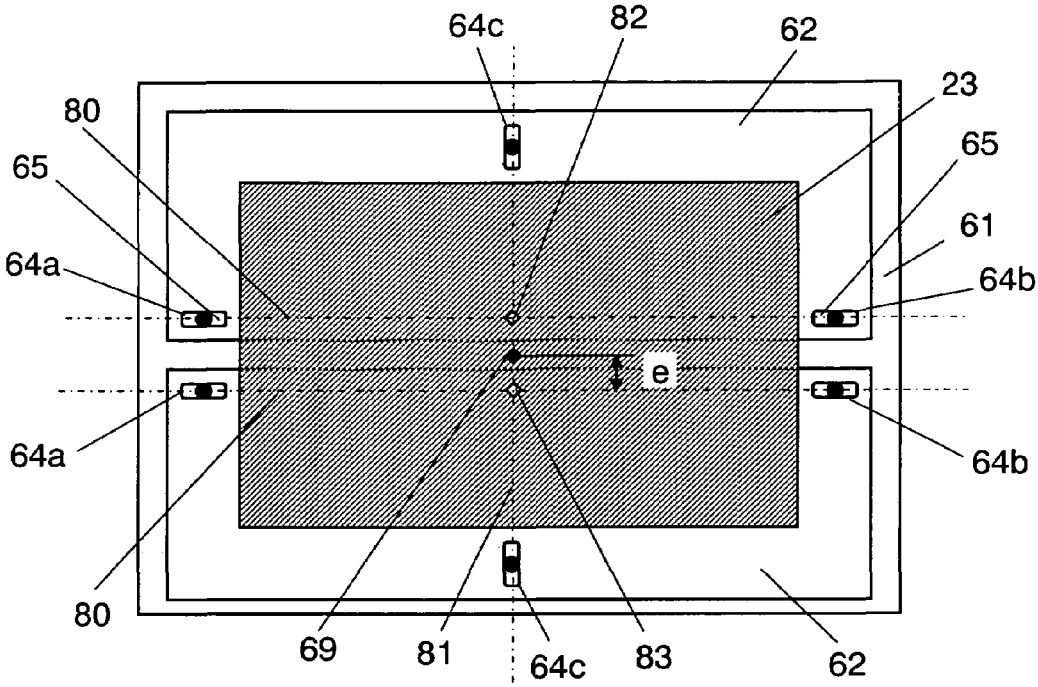
FIG. 18 shows a plan view illustrating a structure of a supporting bed to be used in a method of manufacturing a display panel in accordance with a seventh embodiment of the present invention.

FIG. 18 shows a structure of a supporting bed to be used in a method of manufacturing display panels in accordance with the seventh embodiment of the present invention. As shown in FIG. 18, two units of second supporting bed 62 are placed side by side along the short side of first supporting bed 61. Substrate 23 straddles these two units. Three regulating sections 64*a*, 64*b*, 64*c* are provided to each one of the two units of second supporting bed 62. The structure of these regulating sections is similar to that used in the fifth and the sixth embodiments; however, the long axis of opening 65 is oriented in a different direction from that in the fifth and the sixth embodiment.

To be more specific, in FIG. 18, regulating section 64*a* has center line 80 of the long axis of opening 65 formed on one of second supporting bed 62, and which center line 80 agrees with the center line of the long axis of regulating section 64*b* of another opening 65 provided to the one of second supporting beds 62. Regulating section 64*c* has center line 81 of the long axis of opening 65 formed on one of the second supporting bed 62, and which center line 81 agrees with the center line of the long axis of another regulating section 64*c* formed on another second supporting bed 62. Two center lines 80 are deviated from center point 69 of first supporting bed 61 by "e" respectively. Thermal expansion center points 82 and 83 of respective second supporting beds 62 form the intersections between center lines 80 and 81 near center point 69 (agreeing with the center point of substrate 23) of first supporting bed 61, and deviate from center point 69 by "e" respectively.

Placement of regulating sections 64*a*, 64*b* and 64*c* such that center points 82 and 83 are placed near center point 69 allows approximating the thermal expanding direction and the thermally expanded volume on second supporting bed 62 to those of substrate 23, so that a length of scratches due to the rubbing between substrate 23 and second supporting bed 62 can be shortened.

The scratches having a length of not longer than 1 mm caused by the rubbing between the substrate and the supporting bed during the baking are difficult to recognize by human eyes, so that few problems occur in terms of appearance or display quality. As a result, distance "e" between center point 69 of substrate 23 and second thermal expansion center point 82 or 83 of the second supporting bed 62 can satisfy formula (2) below.

$$e<1/(2\times(\text{difference in thermal expansion coefficient between the substrate and the second supporting bed})\times Tf) \quad (2)$$

where, e=distance between the center point of substrate and a thermal expansion center point of the second supporting bed, and Tf=baking temperature. In formula (2), since an ambient temperature is substantially lower than the baking temperature, the ambient temperature can be neglected.

Eighth Embodiment

Figure 19:
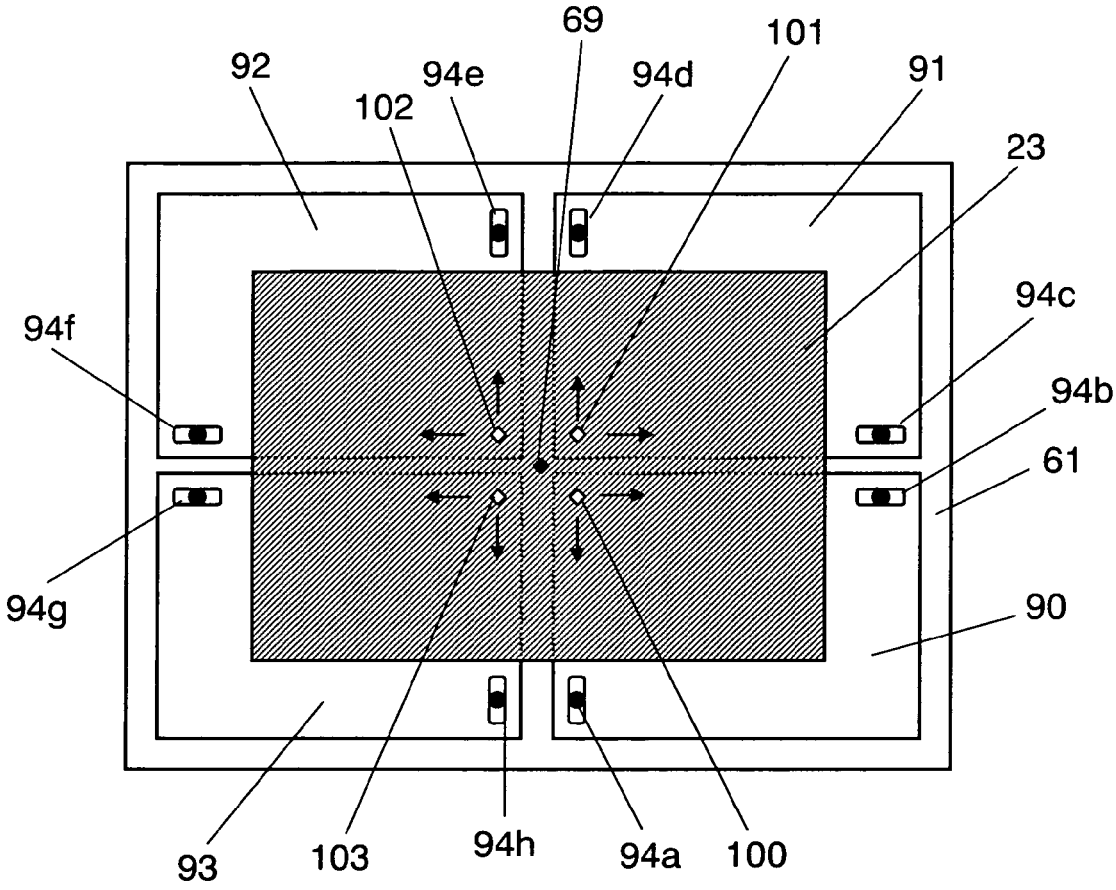
FIG. 19 shows a plan view illustrating a structure of a supporting bed to be used in a method of manufacturing a display panel in accordance with an eighth embodiment of the present invention.

FIG. 19 shows a structure of a supporting bed to be used in a method of manufacturing display panels in accordance with the eighth embodiment of the present invention. As shown in FIG. 19, four units of second supporting bed 90, 91, 92, 93 are placed on first supporting bed 61, and a sheet of substrate 23 straddles the four units. The structure of substrate 23 remains unchanged from that of the embodiments previously discussed, so that the description thereof is omitted here. As FIG. 19 shows, regulating sections 94*a*-94*h* are provided to first supporting bed 61 and second supporting beds 90, 91, 92, and 93. They are placed such that a center line of a long axis of respective openings runs near the center of first supporting bed 61.

The foregoing structure allows thermal expansion center points 100, 101, 102, 103 of second supporting beds 90, 91, 92, 93 to be positioned near the center of first supporting bed 61, so that the expanding directions of these second supporting beds are regulated during the baking. As a result, little rubbing occur between substrate 23 and these second supporting beds 90, 91, 92, and 93, thereby suppressing the production of scratches on substrate 23. When an upsized PDP is manufactured by the multi-panel method, in particular, second supporting beds 90, 91, 92 and 93 made of metal plate containing, e.g. titanium, can be used respectively for a small sized substrate. The cost of manufacturing equipment can be thus reduced.

In the fifth through the eighth embodiments, if opening length "W" along the longitudinal direction shown in FIGS. 15A and 15B is too short, the expansion of the second supporting bed is blocked by regulating pin 66, so that the second supporting bed can be deformed. To prevent this problem, clearance "W" of opening 65 should be greater than a thermally expanded volume of the second supporting bed. To be more specific, length "L" from thermal expansion center point 69 of second supporting bed 62 shown in FIG. 14A to the center of opening 65 should satisfy formula (3) below:

$$W>(\text{thermal expansion coefficient of the second supporting bed})\times Tf\times L \quad (3)$$

where, Tf=baking temperature, and L=a length from the thermal expansion center point of the second supporting bed to the center of the opening. On the other hand, if clearance "D" along the short side of opening 65 is too big, positioning regulation does not effect, thus clearance "D" is preferably equal to or slightly greater than the diameter of regulating pin 66.

The regulating pins can be fixed to the second supporting beds, and those pins are movable in the openings provided to the first supporting bed instead of the foregoing structure. Notches instead of the openings can be provided to the ends of the second supporting bed.

The second supporting bed used in the fifth through the eighth embodiments exists around substrate 23 when the bed has substrate 23 thereon, and substrate 23 straddles the plural second supporting beds. At the straddling sections, substrate 23 thus touches some edges of second supporting beds, so that scratches tend to occur on substrate 23 due to the touches of substrate 23 on the some edges of the second supporting beds. To overcome this problem, at least these some edges, which touch substrate 23, out of all the edges are moderately bent as projections 45*a* are formed in FIG. 10B so that no sharply pointed sections are available on the surfaces where substrate 23 is placed. Grooves are provided to the first supporting bed so that the edges moderately bent can be inserted into the grooves. This structure allows suppressing the production of scratches on substrate 23 due to the touches between substrate 23 and the edges of the second supporting beds.

In the first through the third embodiments and the fifth through the eighth embodiments, the thin metal plate made of titanium to be used as the second supporting bed has a surface roughness "Ra" of not greater than 1 μm, and both the surfaces of this thin plate can be roughened for actual use. Assume that the surface roughness "Ra" on both the surfaces ranges from 3 μm-6 μm, then the thin plate is hard to slide on the first supporting bed, and yet, the substrate is hard to slide on the thin plate, so that movements of the thin plate, i.e. the second supporting bed, and the substrate during baking can be effectively suppressed.

In the embodiments previously discussed, manufacturing PDPs is taken as an example; however, the present invention is useful for manufacturing other display panels such as LCD panels or FED panels.

INDUSTRIAL APPLICABILITY

The present invention realizes the manufacturing of quality display panels at a high yield, and is useful for a manufacturing method of display panels, which methods uses a multiple-panel method and is applicable to large-sized substrates.

The invention claimed is:

1. A method of manufacturing a display panel, the method comprising:

providing a supporting bed, the supporting bed including a first supporting bed and a second supporting bed positioned on the first supporting bed, the first supporting bed having a first thermal expansion coefficient, the second supporting bed having a second thermal expansion coefficient and the second supporting bed having a first surface with a perimeter;

forming a material layer on a substrate, the substrate having a third expansion coefficient and a second surface;

positioning the substrate on the second supporting bed such that the second surface of the substrate touches the first surface of the second supporting bed and the second surface of the substrate is positioned entirely within the perimeter of the first surface of the second supporting bed; and heating and baking the material layer formed on the substrate while maintaining the position of the second surface of the substrate entirely within the perimeter of the first surface of the second supporting bed;

wherein a difference between the third thermal expansion coefficient and the first thermal expansion coefficient is smaller than a difference between the second thermal expansion coefficient and the first thermal expansion coefficient.

2. The manufacturing method of claim 1, wherein the second supporting bed is a bar positioned on the first supporting bed.

3. The manufacturing method of claim 1, wherein the second supporting bed is a metal plate containing titanium.

4. The manufacturing method of claim 1, wherein at least one of the first and the second supporting beds includes a movement suppressing device configured to suppress the movement of the second supporting bed relative to the first supporting bed.

5. The manufacturing method of claim 1, wherein the second supporting bed includes a plurality of second beds, and the heating and baking includes heating and baking the substrate while the substrate straddles the plurality of second beds, and wherein movement of each of the second beds is limited such that a thermally expanding direction of each of the second beds coincides with a thermally expanding direction of the substrate.

6. The manufacturing method of claim 5, wherein a thermal expansion center point of each of the second beds is configured to align with a single point on the first supporting bed.

7. The manufacturing method of claim 5, wherein each of the second beds is a metal plate containing titanium.

8. A supporting bed for heating and baking a substrate, the substrate being for use in a display panel and including a first thermal expansion coefficient and a first surface, the supporting bed comprising:

a first supporting bed having a second thermal expansion coefficient; and a second supporting bed having a third thermal expansion coefficient and a second surface with a perimeter, the second supporting bed configured to be placed on the first supporting bed, wherein a difference between the third thermal expansion coefficient and the first thermal expansion coefficient is smaller than a difference between the second thermal expansion coefficient and the first thermal expansion coefficient, and wherein the second supporting bed is configured such that when the substrate is placed on the second supporting bed the first surface of the substrate touches the second surface of the second supporting bed and the substrate is positioned entirely within the perimeter of the second surface of the second supporting bed.

9. The supporting bed of claim 8, wherein the first supporting bed has a third surface with a first portion and a groove therein, and the second supporting bed is formed from a thin plate constructed and arranged such that one portion of the second supporting bed is adjacent at least the first portion of the third surface and another portion of the second supporting bed is positioned within the groove.

10. The supporting bed of claim 8, wherein the second supporting bed has bumps and dips.

11. The supporting bed of claim 8, wherein the second supporting bed is a bar positioned on the first supporting bed.

12. The supporting bed of claim 8, wherein the second supporting bed is a metal plate containing titanium.

13. The supporting bed of claim 8, wherein at least one of the first and the second supporting beds has a movement suppressing device configured to suppress movement of the second supporting bed relative to the first supporting bed.

14. The supporting bed of claim 8, wherein the second supporting bed includes a plurality of second beds, and the substrate is configured to straddle the plurality of second beds, and wherein at least one of the first supporting bed and every one of the second beds has a regulating section configured to limit movement of each of the second beds such that a thermally expanding direction of every one of the second beds coincides with a thermally expanding direction of the substrate.

15. The supporting bed of claim 14, wherein the regulating section is configured to limit movement of each of the second beds such that a thermal expansion center point of each of the second beds is aligned with a single point on the first supporting bed.

16. The supporting bed of claim 8, further comprising:

a plurality of regulating sections;

wherein the second supporting bed includes a plurality of second beds, and the substrate is configured to straddle the plurality of second beds, wherein each of the regulating sections is configured to limit movement of a predetermined one of the second beds such that a thermal expansion center point of each of the second beds is aligned with a single point on the first supporting bed, and wherein each of the regulating sections includes a regulating pin provided on the first supporting bed and an opening provided in the predetermined second bed, the regulating pin being configured to fit in the opening, the opening having a length and a width, the length being greater than the width and a line bisecting the opening along the length of the opening points in the direction of the single point on the first supporting bed.

17. The supporting bed of claim 16, wherein an opening length along the length of the opening and a distance between a thermal expansion center point of each of the second beds and a center of the opening is defined by:

$$W > (\text{thermal expansion coefficient of the second supporting bed}) \times Tf \times L,$$

where, Tf is the baking temperature, and L is the distance from the thermal expansion center point of each of the second beds to the center of the opening, and W is the opening length.

18. The supporting bed of claim 14, wherein the second supporting bed is a metal plate containing titanium.

19. A supporting bed for heating and baking a substrate, the substrate being for use in a display panel and having a first surface and a first thermal expansion coefficient, the supporting bed comprising:

a first supporting bed having a second thermal expansion coefficient;

a plurality of second supporting beds defining an outer perimeter, each of said second supporting beds having a second surface and a third thermal expansion coefficient, said second supporting beds being configured to be positioned on the first supporting bed; and a regulating section configured to limit each of the plurality of second supporting beds in a thermally expanding direction;

wherein a difference between the third thermal expansion coefficient and the first thermal expansion coefficient is smaller than a difference between the second thermal expansion coefficient and the first thermal expansion coefficient, wherein a portion of the substrate is configured to be placed on each of the second supporting beds such that the first surface touches each of the second surfaces, such that the substrate straddles the plurality of the second supporting beds, and such that the substrate is positioned entirely within the outer perimeter; and wherein a distance between a center point of the substrate straddling the plurality of the second supporting beds and a thermal expansion center point of each of the second supporting beds is related to a thermal expansion coefficient of the substrate and a thermal expansion coefficient of the second supporting bed, and the relation is expressed by:

$$e<1/(2\times(\text{difference in thermal expansion coefficient between the substrate and the second supporting bed})\times Tf),$$

where, e is the distance between the center point of the substrate and the thermal expansion center point of each of the second supporting beds, and Tf is the baking temperature.

* * * * *